US008463532B2

(12) United States Patent
Nakagawa et al.

(10) Patent No.: US 8,463,532 B2
(45) Date of Patent: Jun. 11, 2013

(54) CONTROL DEVICE FOR ENGINE

(75) Inventors: Shinji Nakagawa, Mito (JP); Kazuhiko Kanetoshi, Yokohama (JP); Kouzo Katougi, Hitachi (JP); Takanobu Ichihara, Naka (JP); Minoru Ohsuga, Hitachinaka (JP); Hiroyuki Takamura, Hitachinaka (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 0 days.

(21) Appl. No.: 13/202,350

(22) PCT Filed: Feb. 4, 2010

(86) PCT No.: PCT/JP2010/051582

§ 371 (c)(1),
(2), (4) Date: Aug. 19, 2011

(87) PCT Pub. No.: WO2010/106842

PCT Pub. Date: Sep. 23, 2010

(65) Prior Publication Data

US 2011/0315108 A1 Dec. 29, 2011

(30) Foreign Application Priority Data

Mar. 19, 2009 (JP) ..... 2009-069000

(51) Int. Cl.
*F02D 41/00* (2006.01)

(52) U.S. Cl.
USPC ..... 701/109; 701/113; 123/672; 123/685

(58) Field of Classification Search
USPC ..... 123/672, 673, 685, 703, 704; 60/276, 60/285–286; 701/103, 105, 109, 113
See application file for complete search history.

(56) References Cited

U.S. PATENT DOCUMENTS

| | | | | |
|---|---|---|---|---|
| 4,251,990 | A * | 2/1981 | Norimatsu et al. | 60/276 |
| 6,600,998 | B1 | 7/2003 | Majima et al. | |
| 7,257,943 | B2 * | 8/2007 | Midlam-Mohler et al. | 60/285 |
| 7,918,085 | B2 * | 4/2011 | Yoshioka | 60/286 |

FOREIGN PATENT DOCUMENTS

| | | | |
|---|---|---|---|
| JP | 10-141117 | A | 5/1998 |
| JP | 2001-115879 | A | 4/2001 |
| JP | 2006-37964 | A | 2/2006 |
| JP | 2007-198352 | A | 8/2007 |
| JP | 2008-190477 | A | 8/2008 |
| JP | 2010-223023 | * | 10/2010 |

OTHER PUBLICATIONS

Corresponding International Search Report dated Mar. 30, 2010 (two (2) pages). Form PCT/ISA/237 (four (4) pages).

* cited by examiner

*Primary Examiner* — Hai Huynh
(74) *Attorney, Agent, or Firm* — Crowell & Moring LLP

(57) ABSTRACT

Provided is a control device for an engine which is capable of purifying NOx with high efficiency at a restart after an idle stop without deteriorating purification efficiency of HC and CO. At the restart after the idle stop, an air-fuel ratio is controlled to be rich, and an atmosphere inside of a catalyst is estimated on the basis of a required time ΔT from a time point at which an output value (VO2_2) of first oxygen concentration detection means upstream of the catalyst exceeds a predetermined value A1 to a time point at which an output value (VO2_2) of second oxygen concentration detection means downstream of the catalyst exceeds a predetermined value A2, whereby an air-fuel ratio at next and subsequent restarts is corrected so that the atmosphere inside of the catalyst is optimized at the next and subsequent restarts.

15 Claims, 33 Drawing Sheets

<Basic fuel injection amount calculation means 120>

*1) "Stop of engine" corresponds to when f_Operated = 0.
"Start of engine" corresponds to when change is made so that f_Operated = 0 → 1.

CONTROL DEVICE FOR ENGINE

TECHNICAL FIELD

The present invention relates to a control device for an engine, and more particularly, to a control device for an engine which is capable of efficiently suppressing exhaust deterioration at the restart after an idle stop, in an idle stop system which stops the engine during the idling for the purposes of improving fuel efficiency and reducing a CO2 emission amount.

BACKGROUND ART

Against a backdrop of a worsening global warming problem and an energy problem, demands for an automobile to improve fuel efficiency and reduce a CO2 emission amount have been increasing higher than ever before. An idle stop is effective for improving the fuel efficiency and reducing the CO2 emission amount. However, there is a problem that exhaust (mainly, NOx) is deteriorated at the restart after the idle stop. This is caused by an oxygen storage/release function with which a catalyst is generally provided and which is referred to as an OSC (O2 Storage Capacity). The OSC function serves as a function of storing oxygen in a lean atmosphere (oxidizing atmosphere) with respect to a stoichiometric state, and conversely, serves as a function of releasing oxygen in a rich atmosphere (reducing atmosphere) with respect to the stoichiometric state. For this reason, when fuel injection is stopped during the idle stop, air (having a high oxygen concentration) flows out into an exhaust pipe, and hence the inside of the catalyst is brought into an oxygen saturation state (strong oxidizing atmosphere) by the OSC function. If an engine is restarted in this state, a gas emitted from the engine is stoichiometric or rich, and hence oxygen is released due to the OSC function. As a result, the atmosphere inside of the catalyst changes from the strong oxidizing atmosphere to the stoichiometric atmosphere. However, the atmosphere inside of the catalyst is the oxidizing atmosphere during a given period which is the transition period therefor, and hence HC and CO are purified (oxidized), whereas NOx cannot be purified (reduced).

For example, Patent Document 1 given below discloses a method in which, if an oxygen sensor downstream of a catalyst detects a lean state at the restart after an idle stop, it is determined that the atmosphere inside of the catalyst is lean, whereby rich control is performed.

Patent Document 1: JP Patent Publication (Kokai) No. 2006-37964 A

DISCLOSURE OF THE INVENTION

Problems to be Solved by the Invention

As described above, the inside of the catalyst is the strong oxidizing atmosphere at the restart after the idle stop, and hence HC and CO are purified (oxidized), whereas NOx cannot be purified (reduced). Therefore, it is necessary to rapidly change the inside of the catalyst from the strong oxidizing atmosphere to an optimal atmosphere. An exhaust air-fuel ratio is made rich, and a reducing agent is fed to the catalyst, whereby the oxidizing atmosphere inside of the catalyst can be attenuated. However, if the reducing agent is excessively fed, the inside of the catalyst becomes the reducing atmosphere conversely. As a result, NOx can be purified with high efficiency, whereas the purification efficiency of HC and CO is considerably decreased. In order to purify with high efficiency all of HC, CO, and NOx through the catalyst at the restart, it is necessary to bring the atmosphere inside of the catalyst as closer to the vicinity of the stoichiometric state as possible (bring the OSC inside of the catalyst into an optimal state).

The present invention has been made in view of the above-mentioned circumstances, and therefore has an object to provide a control device for an engine which is capable of purifying with high efficiency all of HC, CO, and NOx through a catalyst, to thereby efficiently suppress exhaust deterioration at the restart after an idle stop.

Means for Solving the Problems

In order to achieve the above-mentioned object, a control device for an engine according to the present invention mainly performs control at a restart after an idle stop. In a first aspect thereof, basically, as illustrated in FIG. 1, the control device for the engine includes: first oxygen concentration detection means which is provided upstream of a catalyst; second oxygen concentration detection means which is provided downstream of the catalyst; means which controls an air-fuel ratio at the restart to be rich (rich control means); means which detects, at the restart, a required time ΔT from a time point at which an output value (VO2_1) of the first oxygen concentration detection means exceeds a predetermined value A1 to a time point at which an output value (VO2_2) of the second oxygen concentration detection means exceeds a predetermined value A2 (required time detection means); and means which corrects an air-fuel ratio at next and subsequent restarts on the basis of the required time ΔT (air-fuel ratio correction means).

The first aspect is described below in detail. As described above, in order to suppress exhaust deterioration at the restart, it is necessary to bring the atmosphere inside of the catalyst as closer to the vicinity of the stoichiometric state as possible (bring the OSC inside of the catalyst into an optimal state). However, in the case where the air-fuel ratio is controlled at the restart to be rich, as the atmosphere inside of the catalyst comes closer to the optimal state (from the rich side), the required time ΔT becomes longer. This is caused by the following two influences:

1. a relation of an oxygen concentration contained in exhaust with respect to an air-fuel ratio; and
2. an oxygen storage/release function inside of a catalyst.

First, a description is given of "1. the relation of the oxygen concentration contained in the exhaust with respect to the air-fuel ratio". On the lean side from the stoichiometric state, the oxygen concentration with respect to the air-fuel ratio rapidly increases in a substantially linear manner as the air-fuel ratio becomes leaner. Specifically, the oxygen concentration is approximately 0.5% in the vicinity of the stoichiometric state, and is approximately 4% at an air-fuel ratio of 18. On the other hand, on the rich side from the stoichiometric state, the oxygen concentration decreases as the air-fuel ratio becomes richer, but the sensitivity is small. Specifically, the oxygen concentration is 0.5% in the stoichiometric state, and is approximately 0.1% at an air-fuel ratio of 13. In the case where the air-fuel ratio is changed from an atmosphere state to the rich region at the restart, the oxygen concentration contained in the exhaust rapidly decreases in a substantially linear manner from 20%→0.5% until the air-fuel ratio changes from the atmosphere state to the stoichiometric state. However, after the air-fuel ratio has exceeded the stoichiometric state to enter the rich region, even if the air-fuel ratio becomes rich to some degree, the oxygen concentration hardly decreases any more. This is "1. the relation of the oxygen concentration contained in the exhaust with respect to the air-fuel ratio".

Next, a description is given of "2. the oxygen storage/release function inside of the catalyst". In general, a component called catalytic promoter (such as ceria) is supported inside of the catalyst. The catalytic promoter has the OSC function (the function of storing and releasing oxygen) as described above, and oxygen is stored or released in accordance with the balance between the stored oxygen concentration and the oxygen concentration contained in the exhaust flowing into the catalyst. That is, I. when (stored oxygen concentration)>(oxygen concentration contained in exhaust), oxygen is released until (stored oxygen concentration)=(oxygen concentration contained in exhaust).

On the other hand,

II. when (stored oxygen concentration)<(oxygen concentration contained in exhaust), oxygen is stored until (stored oxygen concentration)=(oxygen concentration contained in exhaust).

With this, when the air-fuel ratio at an entrance of the catalyst becomes richer than the stoichiometric state of the air-fuel ratio due to a certain disturbance, the phenomenon I prevents the air-fuel ratio inside of the catalyst from becoming rich, to thereby avoid a decrease in purification efficiency of HC and CO. On the other hand, when the air-fuel ratio at the entrance of the catalyst becomes lean, the phenomenon II occurs to prevent the air-fuel ratio inside of the catalyst from becoming lean, to thereby avoid a decrease in purification efficiency of NOx. This is "2. the oxygen storage/release function inside of the catalyst". Owing to "1. the relation of the oxygen concentration contained in the exhaust with respect to the air-fuel ratio" and "2. the oxygen storage/release function inside of the catalyst", when the air-fuel ratio is made richer than the stoichiometric state at the restart after the idle stop, the outputs from the catalyst upstream and downstream O2 sensors exhibit the following profiles. Before the restart, the OSC inside of the catalyst is in the saturation state due to the idle stop (the inside of the catalyst has an oxygen concentration corresponding to an atmosphere). When the engine is restarted with the air-fuel ratio being made richer than the stoichiometric state, the oxygen concentration contained in the exhaust flowing into the catalyst decreases from 20% corresponding to an atmosphere to 0.5% or lower. Because the oxygen concentration gradually decreases, oxygen inside of the catalyst is released by the phenomenon I of "2. the oxygen storage/release function inside of the catalyst" described above. At this time, owing to "1. the relation of the oxygen concentration contained in the exhaust with respect to the air-fuel ratio", the oxygen concentration rapidly decreases until the stoichiometric state is reached, and hence oxygen stored in the OSC is rapidly released.

On the other hand, when the air-fuel ratio exceeds the stoichiometric state to be on the rich side, the oxygen concentration does not decrease as significantly as the change of the air-fuel ratio to the rich side, so that an oxygen release speed slows down. As the rich level becomes closer to the stoichiometric state (optimal state), the oxygen release speed further slows down, and hence a period of time until the "air-fuel ratio inside of the catalyst" and the "air-fuel ratio of the inflowing exhaust" coincide with each other (until a balanced state is reached) becomes longer. The air-fuel ratio of the inflowing exhaust can be detected by the first oxygen concentration detection means (O2 sensor or A/F sensor) upstream of the catalyst. The "air-fuel ratio inside of the catalyst" can be detected by the second oxygen concentration detection means (O2 sensor or A/F sensor) downstream of the catalyst. Accordingly, for example, in the case where the oxygen concentration detection means upstream and downstream of the catalyst are O2 sensors, a required time ΔT until the "air-fuel ratio inside of the catalyst" and the "air-fuel ratio of the inflowing exhaust" coincide with each other (until the balanced state is reached) corresponds to the time required from the time point at which the output from the catalyst upstream O2 sensor exceeds the predetermined value A1 to the time point at which the output from the catalyst downstream O2 sensor exceeds the predetermined value A2.

In this way, it is possible to detect whether or not the air-fuel ratio at the restart is controlled on the basis of the required time ΔT so that the atmosphere inside of the catalyst is optimized (comes into the vicinity of the stoichiometric state). If the atmosphere is not optimized, the air-fuel ratio at the next and subsequent restarts is corrected. It should be noted that this principle can be realized, whether the oxygen concentration detection means upstream and downstream of the catalyst are so-called O2 sensors or A/F sensors. The first aspect corresponds to the case where a so-called O2 sensor is used as the oxygen concentration detection means (first oxygen concentration detection means) upstream of the catalyst (this feature is different from a second aspect to be described next), and an O2 sensor is also used as the oxygen concentration detection means (second oxygen concentration detection means) downstream of the catalyst.

In the second aspect of the control device for the engine according to the present invention, means different from that of the first aspect is used as the oxygen concentration detection means (first oxygen concentration detection means) upstream of the catalyst. As illustrated in FIG. 2, the control device for the engine includes: first oxygen concentration detection means which is provided upstream of a catalyst; second oxygen concentration detection means which is provided downstream of the catalyst; means which controls an air-fuel ratio at a restart to be rich; means which detects, at the restart, a required time ΔT from a time point at which an output value (AF_1) of the first oxygen concentration detection means falls below a predetermined value A1*af* to a time point at which an output value (VO2_2) of the second oxygen concentration detection means exceeds a predetermined value A2; and means which corrects an air-fuel ratio at next and subsequent restarts on the basis of the required time ΔT.

That is, the second aspect corresponds to the case where a so-called A/F sensor is used as the oxygen concentration detection means (first oxygen concentration detection means) upstream of the catalyst, and an O2 sensor is used as the oxygen concentration detection means (second oxygen concentration detection means) downstream of the catalyst.

In a third aspect, as illustrated in FIG. 3, the predetermined value A1 and the predetermined value A2 in the first aspect are each set to a value equal to or larger than 0.5 V.

That is, in the third aspect, in the case where both of the catalyst upstream and downstream sensors are the O2 sensors, as described above, the air-fuel ratio at the restart is set to be richer than the stoichiometric state, and the required time ΔT from the time point at which the output value of the catalyst upstream O2 sensor exceeds the predetermined value A1 to the time point at which the output value of the catalyst downstream O2 sensor exceeds the predetermined value A2 is detected. At this time, A1 and A2 are each set to be equal to or larger than 0.5 V as a threshold value for determining the rich state.

In a fourth aspect, as illustrated in FIG. 4, the air-fuel ratio correction means corrects the air-fuel ratio at the next and subsequent restarts so that the required time ΔT in the first, second, and third aspects is equal to or larger than the predetermined time T1.

That is, as described above, when the rich level is brought gradually closer to the stoichiometric state (optimal state), the required time ΔT until the "air-fuel ratio inside of the catalyst" and the "air-fuel ratio of the inflowing exhaust" coincide with each other (until the balanced state is reached) becomes longer. On the basis of this fact, when ΔT becomes equal to or larger than the predetermined time T1, it is determined that the atmosphere inside of the catalyst has reached the vicinity of the stoichiometric state (optimal state). In order to make ΔT equal to or larger than the predetermined time T1, the rich level of the air-fuel ratio is made lower (for example, a fuel amount is reduced).

In a fifth aspect, as illustrated in FIG. 5, the control device for the engine further includes means which changes the predetermined time T1 in the fourth aspect in accordance with at least one of a maximum oxygen storageable amount and an intake air amount of the catalyst.

That is, as the rich level comes closer to the stoichiometric state, the required time ΔT until the "air-fuel ratio inside of the catalyst" and the "air-fuel ratio of the inflowing exhaust" coincide with each other (until the balanced state is reached) becomes longer, and in addition to this, ΔT has sensitivity to the OSC performance (=the maximum oxygen storageable amount) and the intake air amount. In order to accurately detect on the basis of ΔT whether or not the atmosphere inside of the catalyst is in the vicinity of the stoichiometric state (optimal state), the predetermined time T1 is changed in accordance with the maximum oxygen storageable amount or the intake air amount which is a sensitivity factor other than the rich level. It should be noted that there are a large number of conventional technologies concerning a method of detecting the maximum oxygen storageable amount (OSC performance), and hence the details thereof are not described herein.

In a sixth aspect, as illustrated in FIG. 6, in addition to the configuration of the above-mentioned aspects, the control device for the engine further includes means which detects a difference between an actual air-fuel ratio at the restart and a target air-fuel ratio on the basis of the required time ΔT, and the air-fuel ratio correction means corrects the air-fuel ratio at the next and subsequent restarts on the basis of the difference.

That is, as described above, as the rich level comes closer to the stoichiometric state, the required time ΔT until the "air-fuel ratio inside of the catalyst" and the "air-fuel ratio of the inflowing exhaust" coincide with each other (until the balanced state is reached) becomes longer. Accordingly, it is possible to detect the difference between the actual air-fuel ratio at the restart and the target air-fuel ratio on the basis of the required time ΔT. On the basis of the difference, the air-fuel ratio at the next and subsequent restarts is corrected so as to be the target air-fuel ratio.

In a seventh aspect, as illustrated in FIG. 7, the control device for the engine in each of the first, third, fourth, fifth, and sixth aspects includes, as the required time detection means: means which detects a required time ΔTa from the time point at which the output value (VO2_1) of the first oxygen concentration detection means exceeds the predetermined value A1 to the time point at which the output value (VO2_2) of the second oxygen concentration detection means exceeds the predetermined value A2; and means which detects a required time ΔTb from a time point at which the output value (VO2_1) of the first oxygen concentration detection means exceeds a predetermined value B1 to a time point at which the output value (VO2_2) of the second oxygen concentration detection means exceeds a predetermined value B2, and the air-fuel ratio correction means corrects the air-fuel ratio at the next and subsequent restarts on the basis of at least one of ΔTa and ΔTb.

That is, as described above, as the rich level comes closer to the stoichiometric state, the required time ΔT until the "air-fuel ratio inside of the catalyst" and the "air-fuel ratio of the inflowing exhaust" coincide with each other (until the balanced state is reached) becomes longer. Accordingly, as also described in the third aspect, when the required time ΔT is to be detected, it is desirable to set the threshold value thereof to be on the rich side from the stoichiometric state. On the other hand, in the case where the threshold value is set to be on the lean side, this means that ΔT is detected when the "air-fuel ratio of the inflowing exhaust" and the "air-fuel ratio inside of the catalyst" are in the lean region. As described in the first aspect, in the lean region, the oxygen concentration contained in the exhaust flowing into the catalyst rapidly decreases from 20% corresponding to an atmosphere to 0.5% or lower. Because the oxygen concentration rapidly decreases, oxygen stored inside of the catalyst (OSC) is rapidly released. That is, if the threshold value is set to be in the lean region, ΔT is decided by the OSC (maximum oxygen storageable amount) and the intake air amount in a dominant manner. From the above, for example, when it is assumed that the predetermined value A1 and the predetermined value A2 are threshold values on the rich side and the predetermined value B1 and the predetermined value B2 are threshold values on the lean side, as described above, the required time ΔTa until the threshold values on the rich side are exceeded has sensitivity to three factors, that is, the actual air-fuel ratio (rich level), the maximum oxygen storageable amount, and the intake air amount, whereas the required time ΔTb until the threshold values on the lean side are exceeded has sensitivity to two factors excluding the actual air-fuel ratio, that is, the maximum oxygen storageable amount and the intake air amount in a dominant manner. Accordingly, for example, ΔTa and ΔTb are compared with each other, to thereby eliminate the sensitivity to the maximum oxygen storageable amount and the intake air amount, so that only the sensitivity to the actual air-fuel ratio can be left. Therefore, it is possible to detect with higher accuracy an error until the atmosphere inside of the catalyst reaches the vicinity of the stoichiometric state (the OSC inside of the catalyst is brought into the optimal state).

In an eighth aspect, as illustrated in FIG. 8, the predetermined value A1 is set to a value equal to or larger than the predetermined value B1, the predetermined value A2 is set to a value equal to or larger than the predetermined value B2, and the air-fuel ratio correction means corrects the air-fuel ratio at the next and subsequent restarts so that ΔTa is equal to or larger than a predetermined value T2 and ΔTb is equal to or smaller than a predetermined value T3.

That is, as described in the seventh aspect, the required time ΔTa until the threshold values on the rich side are exceeded has sensitivity to three factors, that is, the actual air-fuel ratio (rich level), the maximum oxygen storageable amount, and the intake air amount, whereas the required time ΔTb until the threshold values on the lean side are exceeded has sensitivity to two factors, that is, the maximum oxygen storageable amount and the intake air amount in a dominant manner. Accordingly, in order to enable ΔTb to have sensitivity to only the maximum oxygen storageable amount and the intake air amount as far as possible (in order to prevent ΔTb from having sensitivity to the air-fuel ratio), ΔTb is made as short as possible. On the other hand, in order to enable ΔTa to have sensitivity to the actual air-fuel ratio (rich level) as far as possible, ΔTa is made as long as possible (may be set to ∞).

This should be clearly noted. It should be noted that, when ΔTb is equal to or smaller than the predetermined value T3 (when ΔTb has sensitivity to only the maximum oxygen storageable amount and the intake air amount in a dominant manner and has almost no sensitivity to the air-fuel ratio (rich level)), ΔTa may have information on the air-fuel ratio (rich level), and the air-fuel ratio at the next restart may be corrected (the rich level may be made lower) so that ΔTa is equal to or larger than the predetermined value T2.

In a ninth aspect, as illustrated in FIG. 9, in addition to the configuration of the seventh aspect, the control device for the engine further includes means which calculates a ratio R_ΔT of ΔTa and ΔTb (ratio calculation means), and the air-fuel ratio correction means corrects the air-fuel ratio at the next and subsequent restarts on the basis of the ratio R_ΔT.

That is, as described in the seventh aspect, the required time ΔTa until the threshold values on the rich side are exceeded has sensitivity to three factors, that is, the actual air-fuel ratio (rich level), the maximum oxygen storageable amount, and the intake air amount, whereas the required time ΔTb until the threshold values on the lean side are exceeded has sensitivity to two factors, that is, the maximum oxygen storageable amount and the intake air amount in a dominant manner. Accordingly, the ratio R_ΔT of ΔTa and ΔTb has stronger information on the actual air-fuel ratio (rich level). Specifically, as R_ΔT becomes larger, the air-fuel ratio comes closer to the stoichiometric state (optimal state). The maximum oxygen storageable amount also depends on temperature and a deterioration state (deterioration degree) of the catalyst, and hence the sensitivity to these factors can be reduced by using the ratio R_ΔT. Therefore, it is possible to detect with higher accuracy the air-fuel ratio (rich level) at the start, and this makes it possible to perform more optimal control. This should be clearly noted.

In a tenth aspect, as illustrated in FIG. 10, the air-fuel ratio correction means corrects the air-fuel ratio at the next and subsequent restarts on the basis of a difference between the ratio R_ΔT calculated by the ratio calculation means and a predetermined value R1.

That is, as described in the ninth aspect, as the ratio R_ΔT becomes larger, the air-fuel ratio comes closer to the stoichiometric state (optimal state). For example, it should be clearly noted that a value of the ratio R_ΔT when the actual air-fuel ratio is in the stoichiometric state or in the vicinity thereof is assumed as R1, and the air-fuel ratio at the next and subsequent restarts is corrected with reference to this value.

In an eleventh aspect, as illustrated in FIG. 11, the predetermined value A1 and the predetermined value A2 in each of the sixth to tenth aspects are each set to a value equal to or larger than 0.5 V, and the predetermined value B1 and the predetermined value B2 in each of the sixth to tenth aspects are each set to a value equal to or smaller than 0.5 V.

That is, as also described in the seventh aspect, the required time ΔTa until the threshold values on the rich side are exceeded has sensitivity to the actual air-fuel ratio (rich level), the maximum oxygen storageable amount, and the intake air amount, whereas the required time ΔTb until the threshold values on the lean side are exceeded has sensitivity to the maximum oxygen storageable amount and the intake air amount in a dominant manner. When both of the oxygen concentration detection means upstream and downstream of the catalyst are the O2 sensors, the threshold values on the rich side are each set to a value equal to or larger than 0.5 V, and the threshold values on the lean side are each set to a value equal to or smaller than 0.5 V.

In a twelfth aspect, as illustrated in FIG. 12, the control device for the engine further includes means which ends rich control at the restart performed by the rich control means, when the output value (VO2_2) of the second oxygen concentration detection means exceeds a predetermined value A3.

That is, in each of the first to eleventh aspects, the timing of ending the rich control is defined as the time point at which the output from the oxygen concentration detection means (O2 sensor) downstream of the catalyst exceeds the predetermined value A3. When the atmosphere inside of the catalyst comes into the stoichiometric or rich state, this is detected by the catalyst downstream O2 sensor. This timing is defined as the time point at which the predetermined value A3 is exceeded. When the atmosphere inside of the catalyst comes into the stoichiometric or rich state, it is not necessary to feed a rich gas to the catalyst any more, and hence the rich control is forcibly ended. It should be additionally noted that A3 does not necessarily need to be equal to or larger than A2. This is because there exists a given delay time from when the air-fuel ratio is made rich by fuel injection to when the catalyst downstream O2 sensor determines the rich state, due to a structural cause of the engine and a transmission characteristic cause of exhaust. For example, even if A3 is set to such a value that A3<A2, the output from the catalyst downstream O2 sensor reaches A2 due to the above-mentioned delay time.

In a thirteenth aspect, as illustrated in FIG. 13, in addition to the configuration of each of the first to twelfth aspects, the control device for the engine further includes means which permits feedback control for correcting a fuel injection amount based on the output value (VO2_1) of the first oxygen concentration detection means and/or the output value (VO2_2) of the second oxygen concentration detection means, after the output value (VO2_2) of the second oxygen concentration detection means has exceeded the predetermined value A2.

That is, as also described in the twelfth aspect, when the atmosphere inside of the catalyst comes into the stoichiometric or rich state, it is not necessary to feed a rich gas to the catalyst any more, and hence the rich control is ended. Further, in order to maintain the inside of the catalyst in the optimal state, the feedback control (well-known technology) on the fuel injection amount is started for performing fuel correction based on the outputs from the oxygen concentration detection means upstream and downstream of the catalyst. Conversely, the feedback control on the fuel injection amount based on the outputs from the oxygen concentration detection means upstream and downstream of the catalyst is not performed (prohibited) during the rich control.

In a fourteenth aspect, as illustrated in FIG. 14, in addition to the configuration of each of the first and third to thirteenth aspects, the control device for the engine further includes means which controls the air-fuel ratio to be richer, if the output value (VO2_1) of the first oxygen concentration detection means does not exceed the predetermined value A1 even after a lapse of a predetermined time TLa1 from a start of the engine or a first fuel injection.

That is, in order to control the air-fuel ratio at the start to be rich, for example, the fuel injection amount is corrected to be increased, but due to an error of the control system or the like, the actual air-fuel ratio may not be as rich as expected in some cases. At this time, even after a lapse of the predetermined time, the catalyst upstream O2 sensor does not output a signal on the rich side (the predetermined value A1 is not exceeded). When this is detected, in order to promptly bring the inside of the catalyst into the optimal state, the actual air-fuel ratio is corrected to be richer.

In a fifteenth aspect, as illustrated in FIG. 15, in addition to the configuration of each of the first and third to thirteenth aspects, the control device for the engine further includes means which permits feedback control for correcting a fuel injection amount based on the output value (VO2_1) of the first oxygen concentration detection means or the output value (VO2_2) of the second oxygen concentration detection means, if the output value (VO2_1) of the first oxygen concentration detection means does not exceed the predetermined value A1 even after a lapse of a predetermined time TLa1 from a start of the engine or a first fuel injection.

That is, as described in the fourteenth aspect, in order to control the air-fuel ratio at the start to be rich, for example, the fuel injection amount is corrected to be increased, but due to an error of the control system or the like, the actual air-fuel ratio may not be as rich as expected in some cases. At this time, even after a lapse of the predetermined time, the catalyst upstream O2 sensor does not output a signal on the rich side (the predetermined value A1 is not exceeded). When this is detected, in order to promptly bring the inside of the catalyst into the optimal state, the feedback control on the fuel injection amount is started.

In a sixteenth aspect, as illustrated in FIG. 16, in addition to the configuration of each of the first and third to thirteenth aspects, the control device for the engine further includes means which controls the air-fuel ratio to be richer, if the output value (VO2_2) of the second oxygen concentration detection means does not exceed the predetermined value A2 even after a lapse of a predetermined time TLa2 from a start of the engine or a first fuel injection.

That is, in order to control the air-fuel ratio at the start to be rich, for example, the fuel injection amount is corrected to be increased. At this time, although the air-fuel ratio upstream of the catalyst becomes as rich as to cause the catalyst upstream O2 sensor to (temporarily) output a signal on the rich side, in some cases, the air-fuel ratio may not become rich enough to bring the atmosphere inside of the catalyst into the stoichiometric to rich state within the predetermined time (the output from the catalyst downstream O2 sensor does not exceed the predetermined value A2). When this is detected, in order to promptly bring the inside of the catalyst into the optimal state, the actual air-fuel ratio is made richer.

In a seventeenth aspect, as illustrated in FIG. 17, in addition to the configuration of each of the first and third to thirteenth aspects, the control device for the engine further includes means which permits feedback control for correcting a fuel injection amount based on the output value (VO2_1) of the first oxygen concentration detection means or the output value (VO2_2) of the second oxygen concentration detection means, if the value of the second oxygen concentration detection means does not exceed the predetermined value A2 even after a lapse of a predetermined time TLa2 from a start of the engine or a first fuel injection.

That is, as also described in the sixteenth aspect, in order to control the air-fuel ratio at the start to be rich, for example, the fuel injection amount is corrected to be increased. At this time, although the air-fuel ratio upstream of the catalyst becomes as rich as to cause the catalyst upstream O2 sensor to (temporarily) output a signal on the rich side, in some cases, the air-fuel ratio may not become rich enough to bring the atmosphere inside of the catalyst into the stoichiometric to rich state within the predetermined time (the output from the catalyst downstream O2 sensor does not exceed the predetermined value A2). When this is detected, in order to promptly bring the inside of the catalyst into the optimal state, the feedback control is started for performing fuel correction based on the outputs from the catalyst upstream and downstream oxygen concentration sensors.

In an eighteenth aspect of the control device for the engine according to the present invention, as illustrated in FIG. 18, the control device for the engine includes: second oxygen concentration detection means which is provided downstream of a catalyst; means which controls an air-fuel ratio at a restart to be rich (rich control means); and means which corrects, within a predetermined time from the restart, an air-fuel ratio at next and subsequent restarts so that an output value (VO2_2) of the second oxygen concentration detection means is equal to or larger than a predetermined value A4 and is equal to or smaller than a predetermined value A5 (air-fuel ratio correction means).

That is, in order to bring the atmosphere inside of the catalyst at the start to the vicinity of the stoichiometric state (bring the OSC inside of the catalyst into the optimal state), the air-fuel ratio at the next and subsequent restarts is corrected so that the output from the catalyst downstream O2 sensor falls within a predetermined range. When the atmosphere inside of the catalyst reaches a substantially balanced state, the output from the catalyst downstream O2 sensor shows the atmosphere inside of the catalyst. Accordingly, the air-fuel ratio at the start may be controlled so that the output from the catalyst downstream O2 sensor has a value (range) corresponding to the stoichiometric state.

In a nineteenth aspect, as illustrated in FIG. 19, the predetermined value A4 in the eighteenth aspect is set to a value equal to or larger than 0.5 V, and the predetermined value A5 in the eighteenth aspect is set to a value equal to or smaller than 0.9 V.

That is, the value (range) corresponding to the stoichiometric state which is described in the eighteenth aspect is defined as a range between 0.5 V and 0.9 V.

In a twentieth aspect, in each of the first to nineteenth aspects, at the restart after the idle stop, an air-fuel ratio profile or a minimum value of the air-fuel ratio during the rich control is changed for each restart.

That is, in each of the first to nineteenth aspects, the air-fuel ratio is corrected for each restart so that the atmosphere inside of the catalyst promptly comes into the optimal state. Accordingly, the air-fuel ratio profile during the rich control or the minimum value (rich level) of the air-fuel ratio during the rich control is changed. This should be clearly noted.

Advantages of the Invention

In a preferred aspect of the control device for the engine according to the present invention, at the restart after the idle stop, the air-fuel ratio is controlled to be rich, and further, the atmosphere inside of the catalyst is estimated on the basis of the required time ΔT from the time point at which the output value at this time of the oxygen concentration detection means upstream of the catalyst exceeds the predetermined value A1 to the time point at which the output value at this time of the oxygen concentration detection means downstream of the catalyst exceeds the predetermined value A2. Then, on the basis of the result of the estimation, the air-fuel ratio (the fuel amount and the air amount) at the next and subsequent restarts is corrected so that the atmosphere inside of the catalyst is optimized at the next and subsequent restarts. Therefore, the atmosphere inside of the catalyst at the restart is optimized each time the restart after the idle stop is repeated. As a result, it becomes possible to purify NOx with high efficiency at the restart without deteriorating the purification efficiency of HC and CO, to thereby efficiently suppress the exhaust deterioration at the restart.

The present description encompasses the contents described in the description and/or the drawings of JP Patent Application No. 2009-069000 on the basis of which the right of priority of the present application is claimed.

DESCRIPTION OF SYMBOLS

Figure 1:
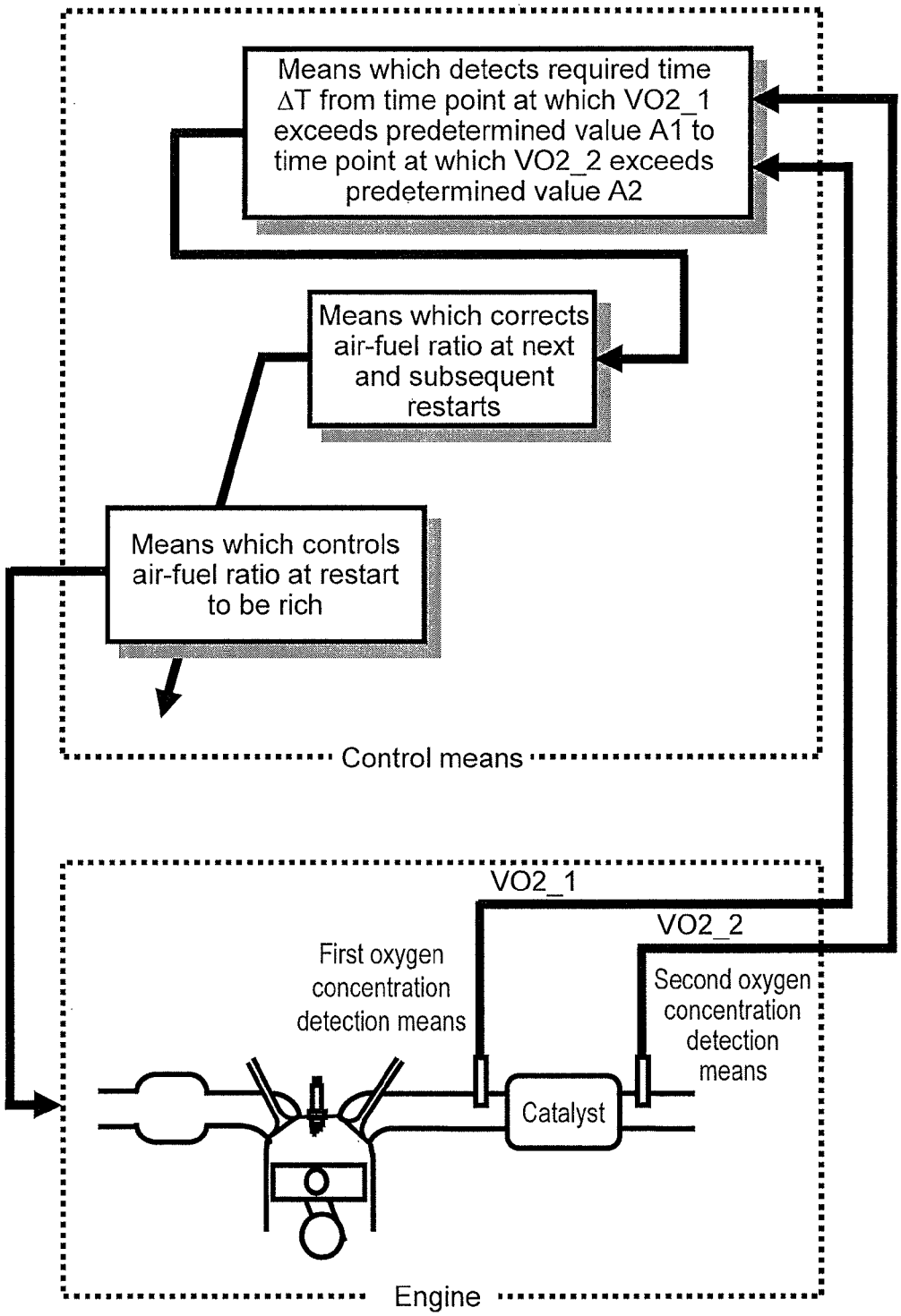
FIG. 1 is a diagram which is used for describing a first aspect of a control device according to the present invention.
Figure 2:
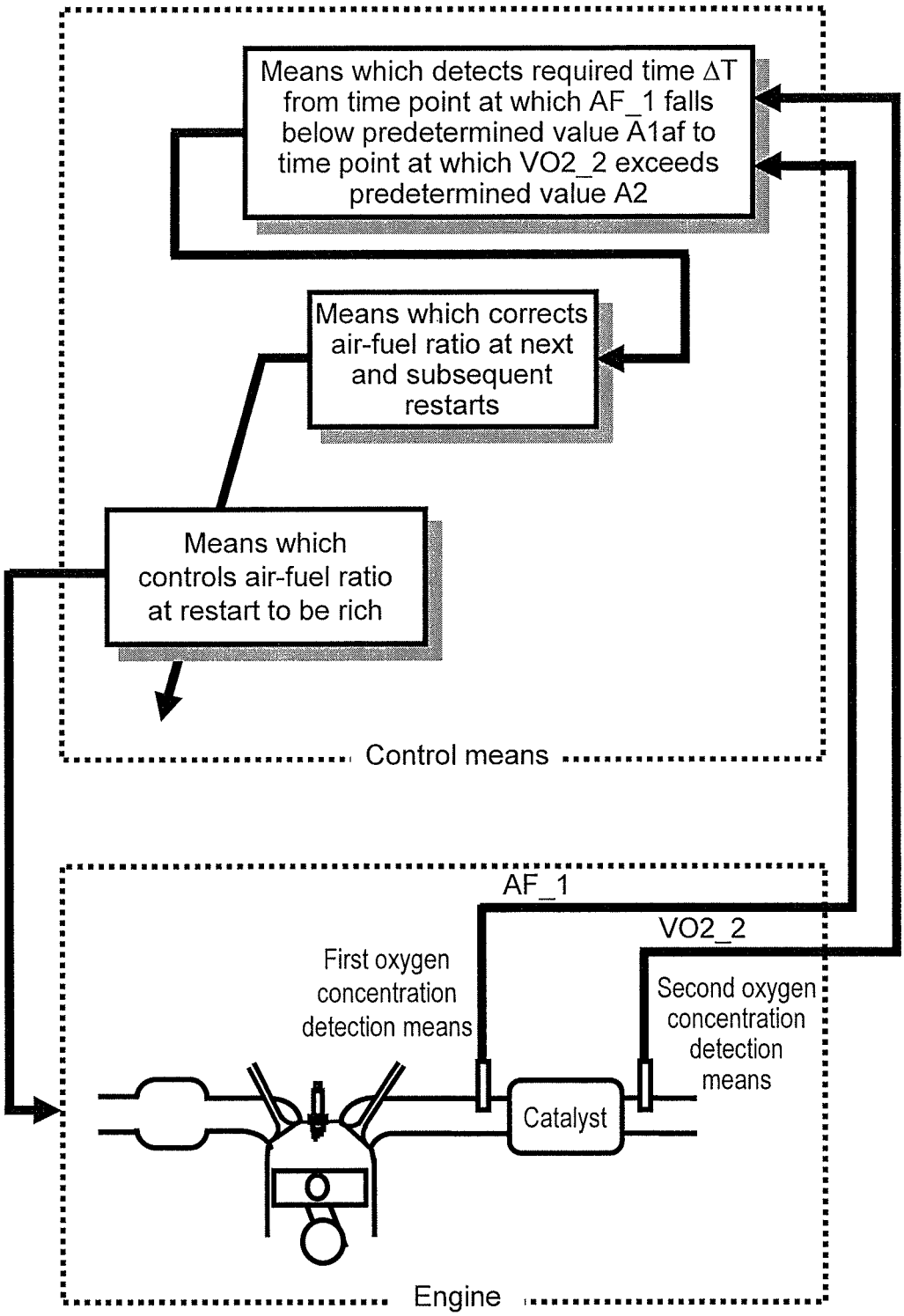
FIG. 2 is a diagram which is used for describing a second aspect of the control device according to the present invention.
Figure 3:
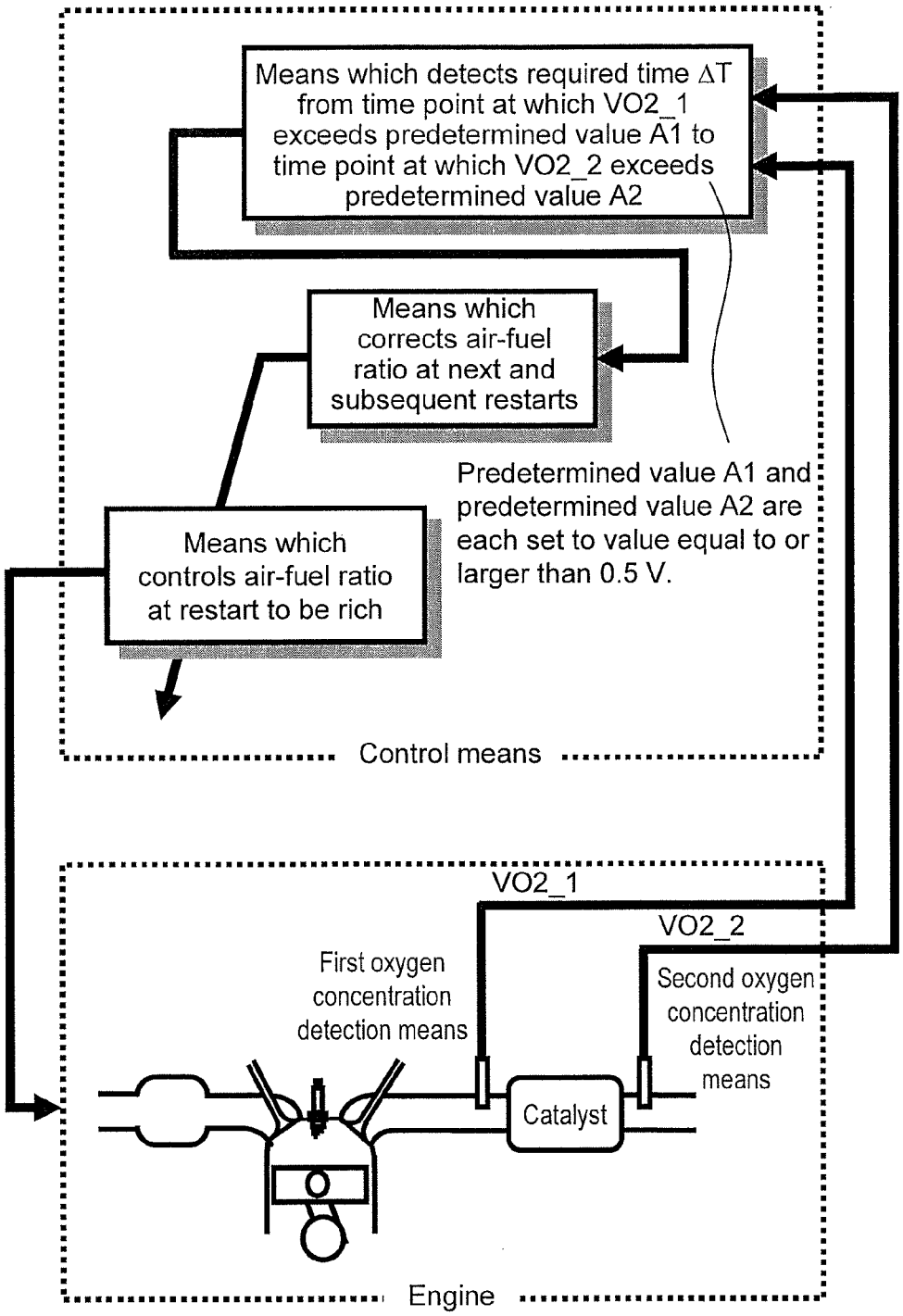
FIG. 3 is a diagram which is used for describing a third aspect of the control device according to the present invention.
Figure 4:
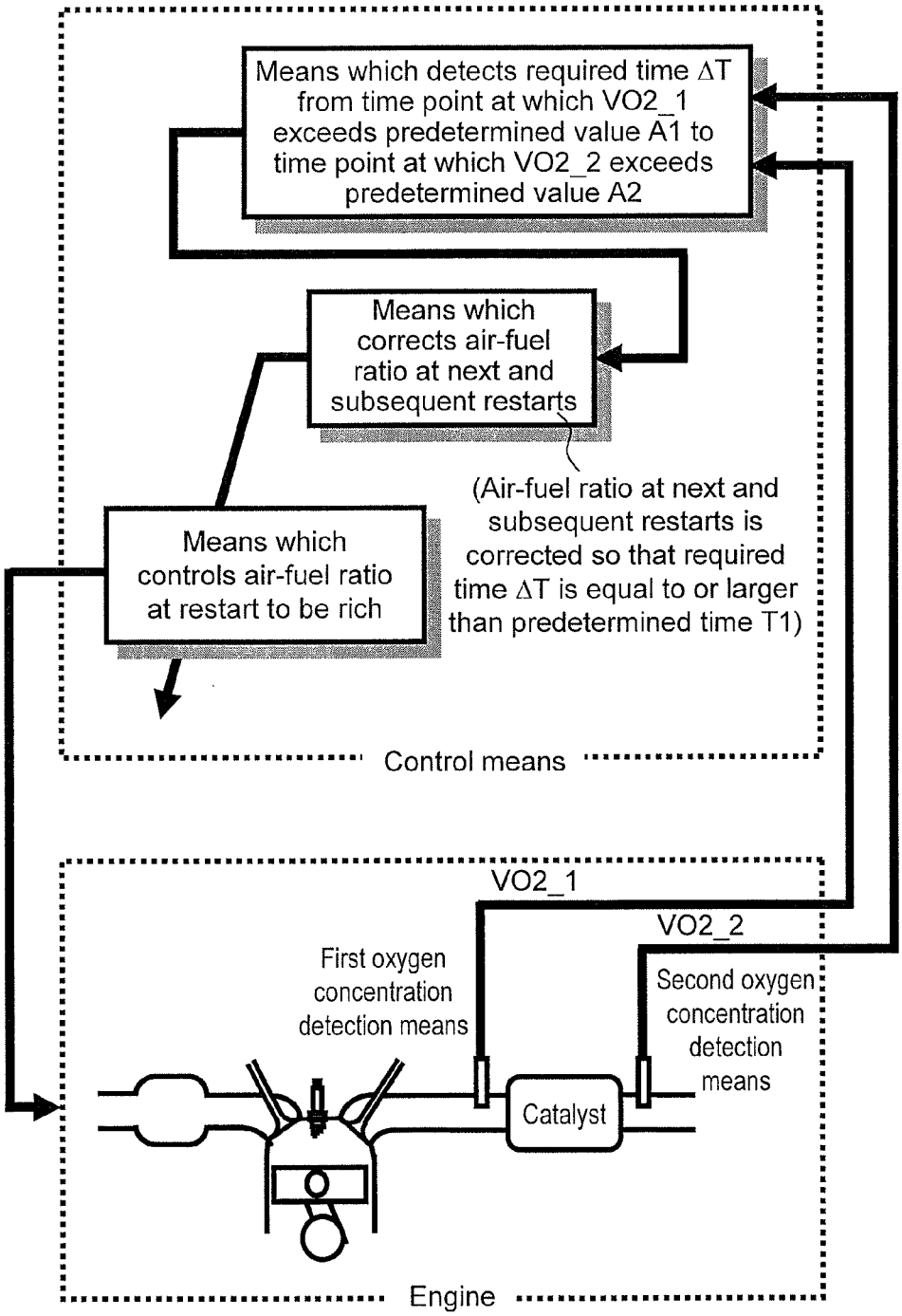
FIG. 4 is a diagram which is used for describing a fourth aspect of the control device according to the present invention.
Figure 5:
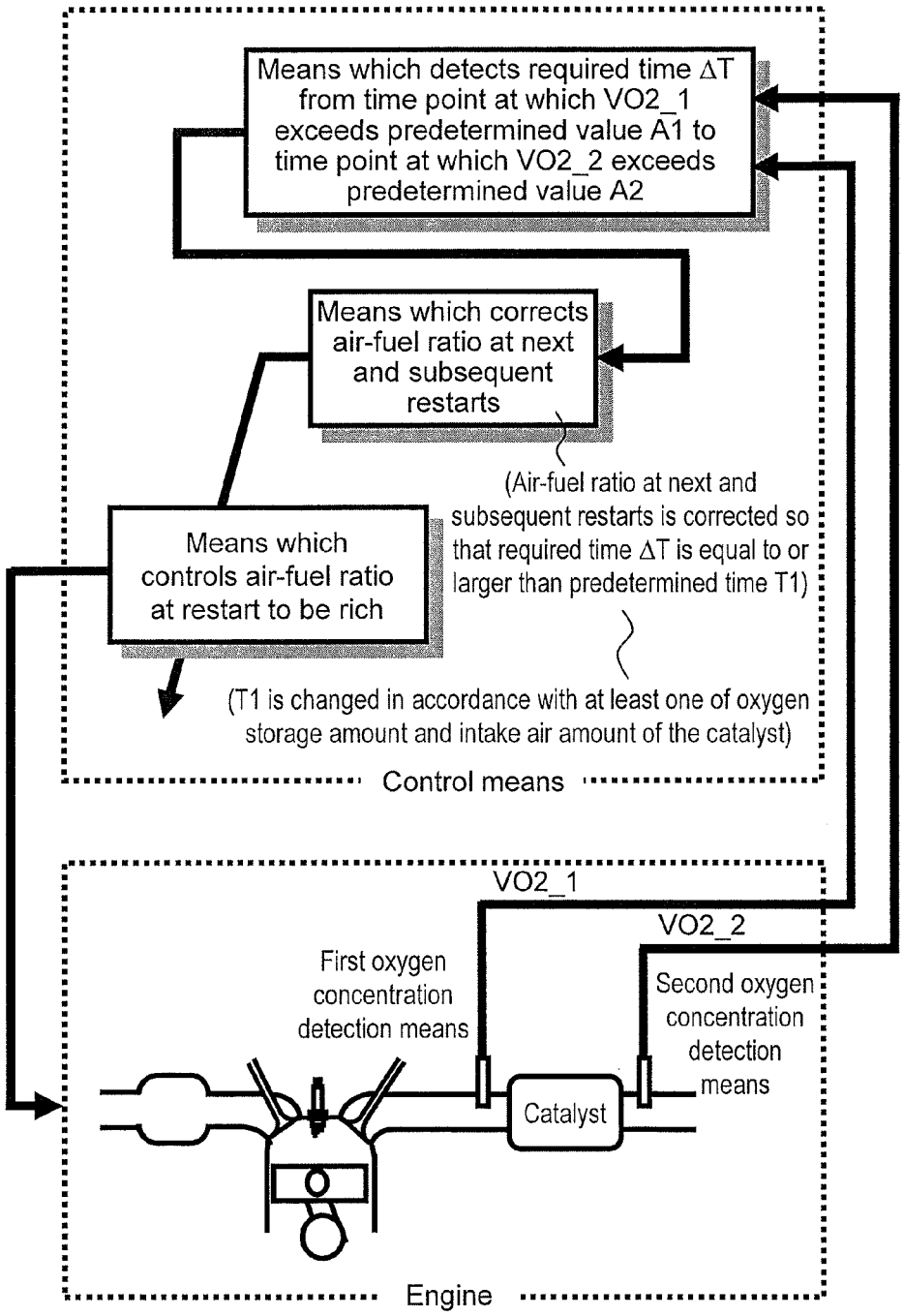
FIG. 5 is a diagram which is used for describing a fifth aspect of the control device according to the present invention.
Figure 6:
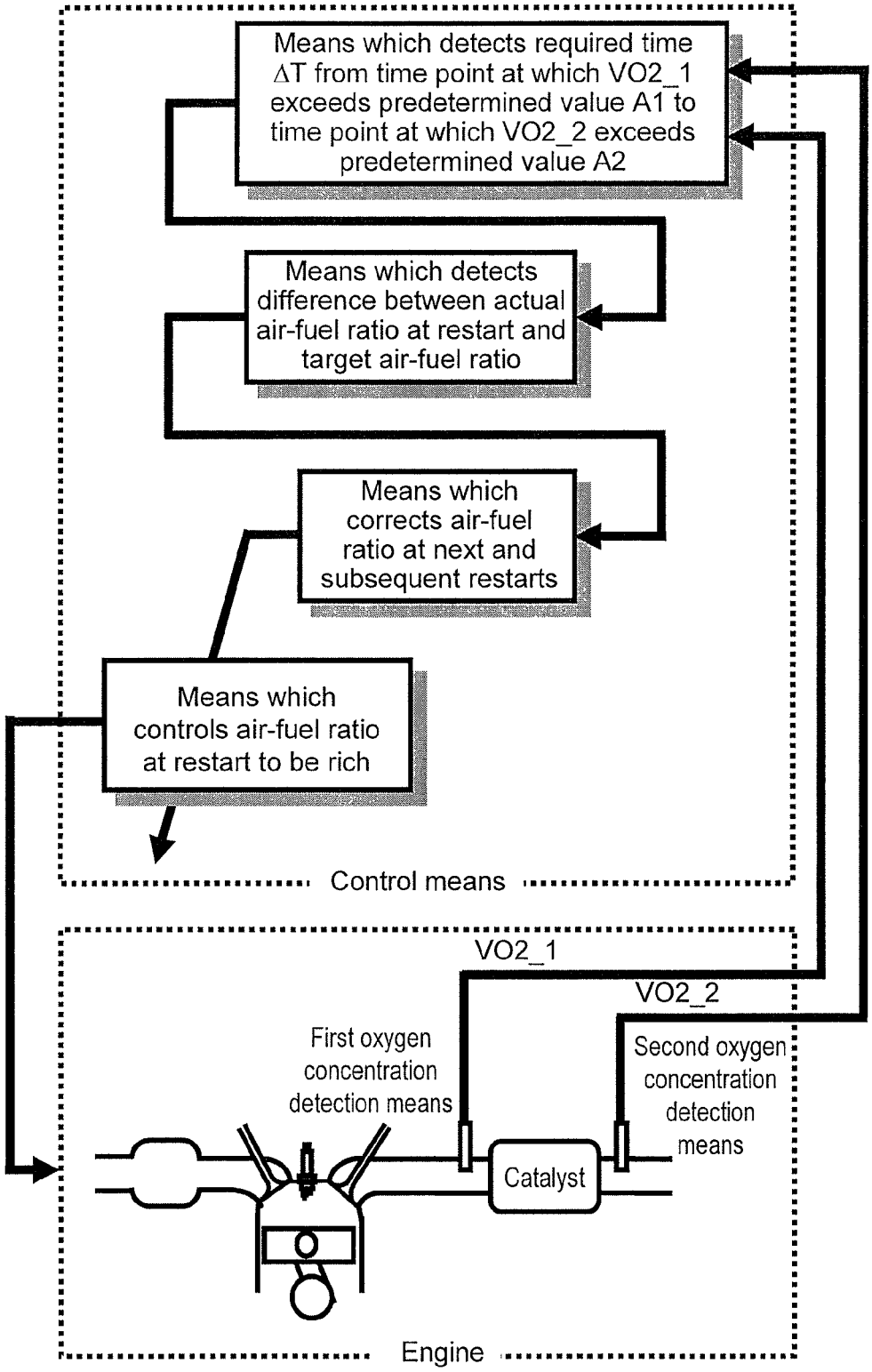
FIG. 6 is a diagram which is used for describing a sixth aspect of the control device according to the present invention.
Figure 7:
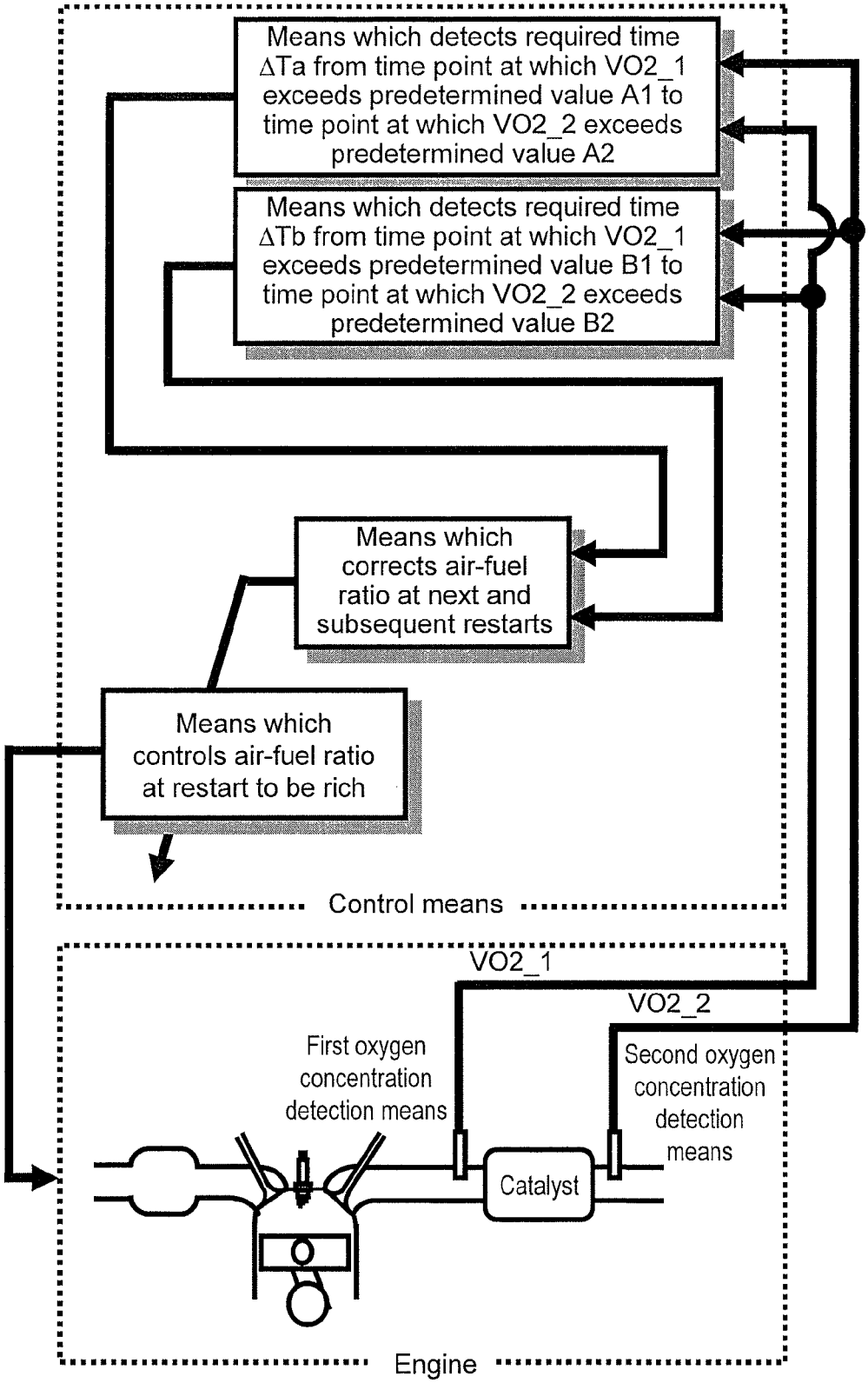
FIG. 7 is a diagram which is used for describing a seventh aspect of the control device according to the present invention.
Figure 8:
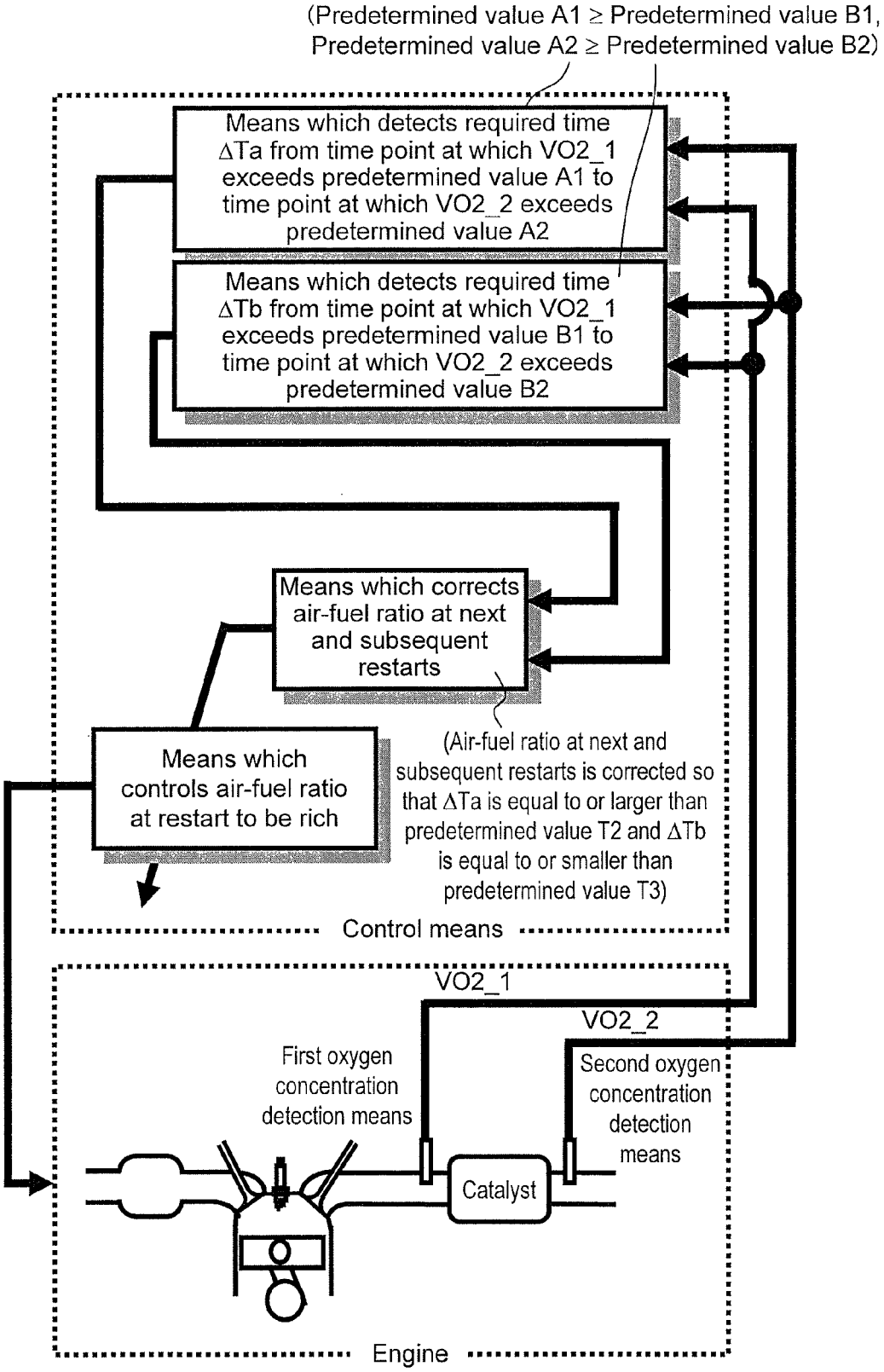
FIG. 8 is a diagram which is used for describing an eighth aspect of the control device according to the present invention.
Figure 9:
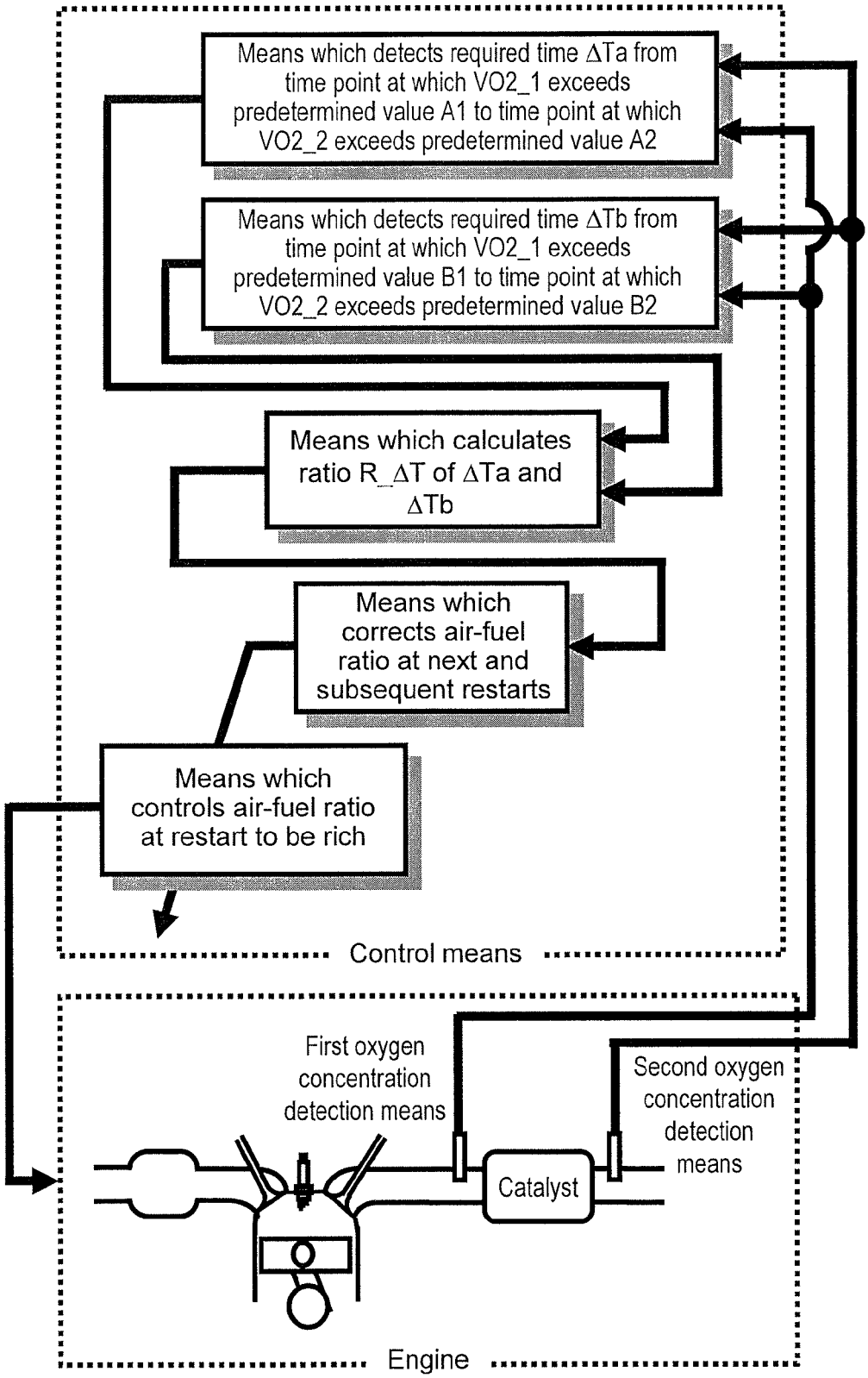
FIG. 9 is a diagram which is used for describing a ninth aspect of the control device according to the present invention.
Figure 10:
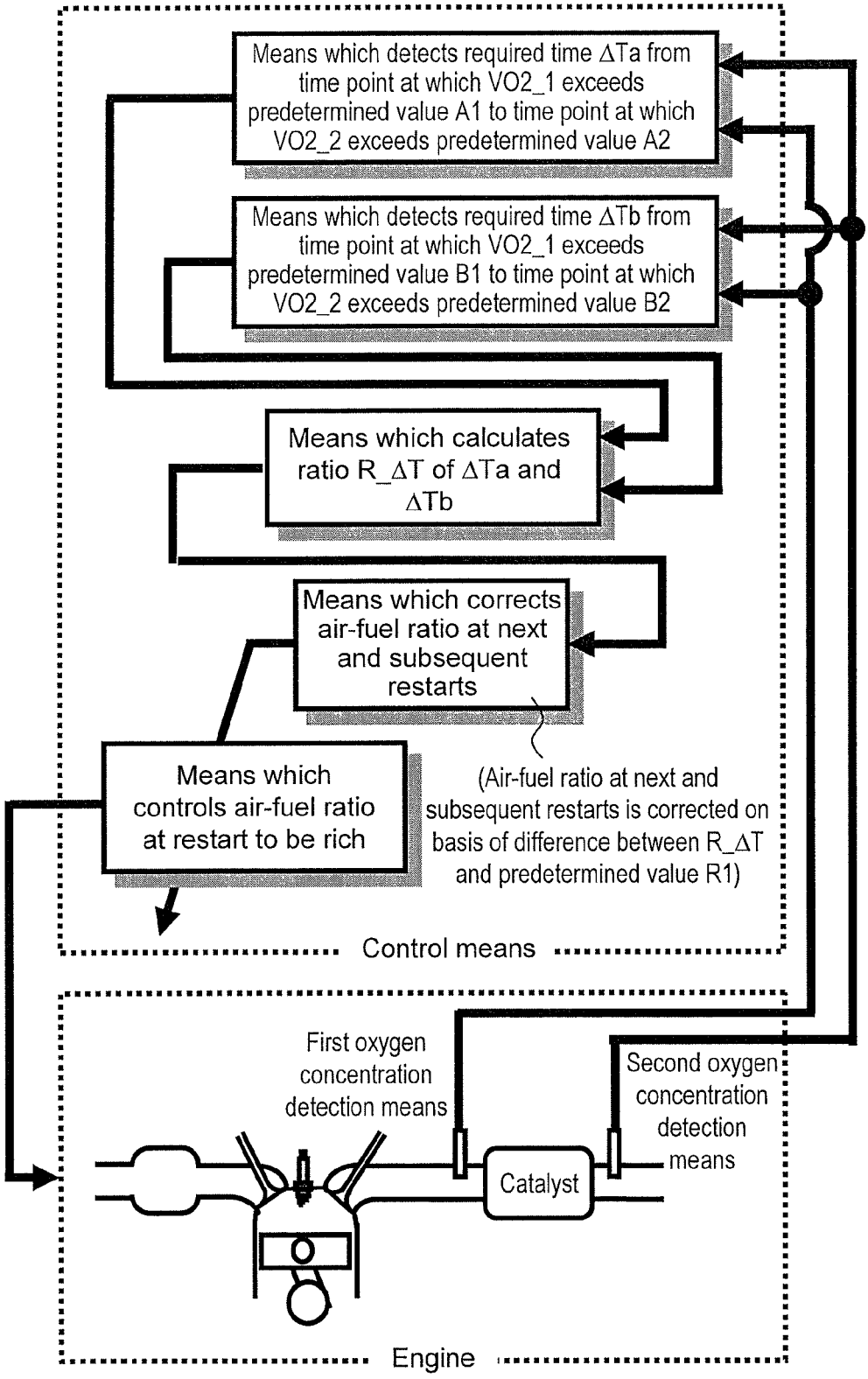
FIG. 10 is a diagram which is used for describing a tenth aspect of the control device according to the present invention.
Figure 11:
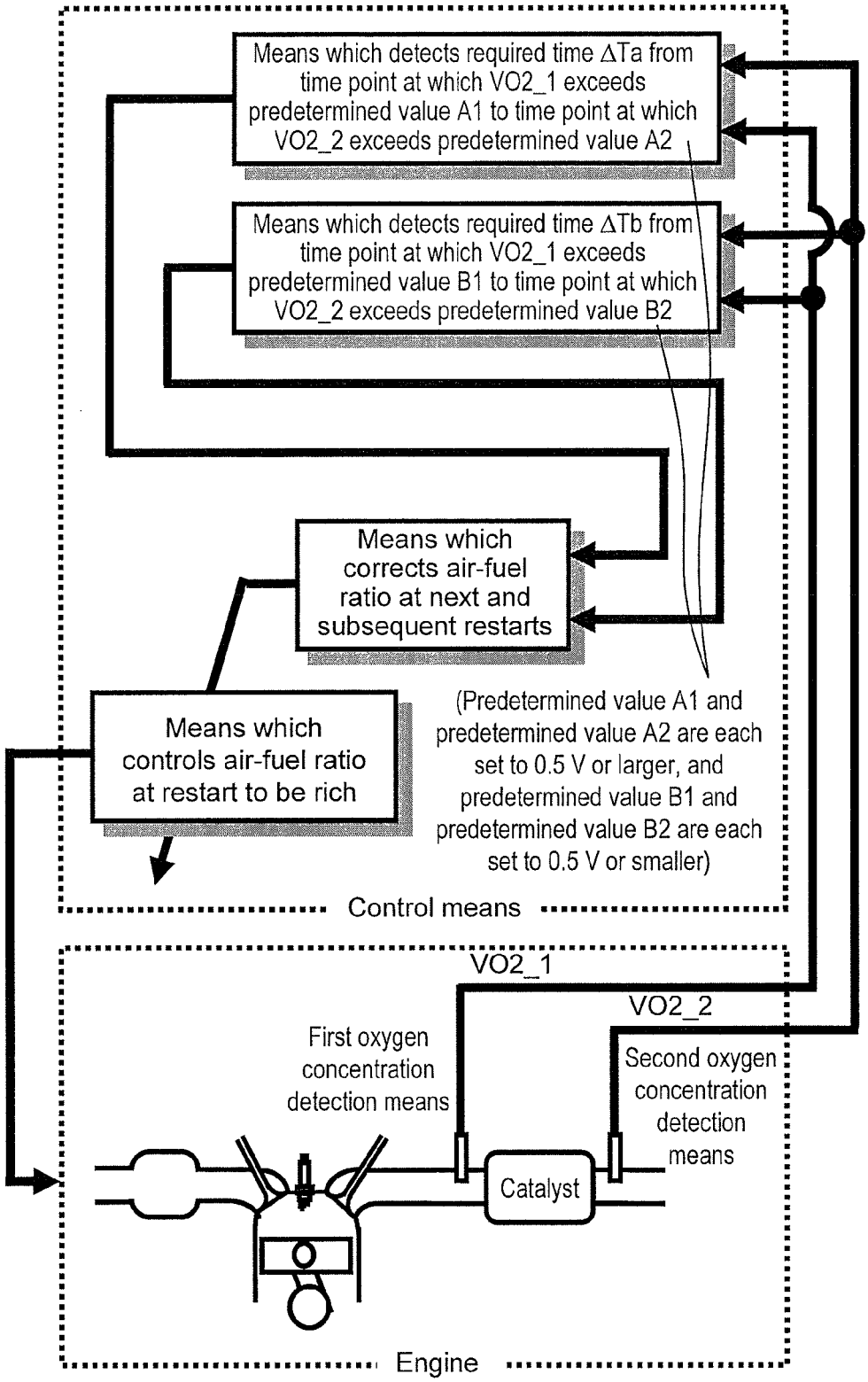
FIG. 11 is a diagram which is used for describing an eleventh aspect of the control device according to the present invention.
Figure 12:
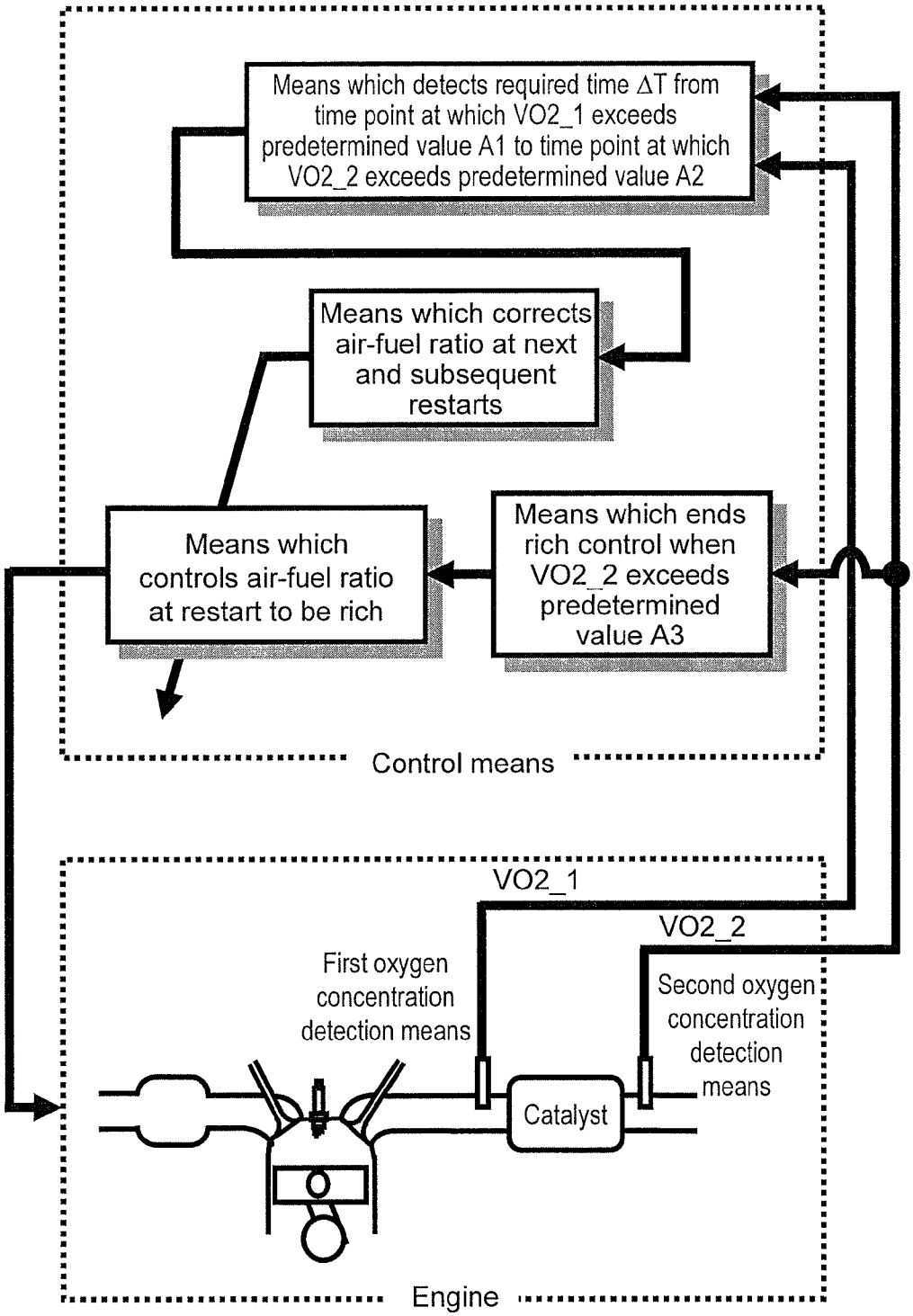
FIG. 12 is a diagram which is used for describing a twelfth aspect of the control device according to the present invention.
Figure 13:
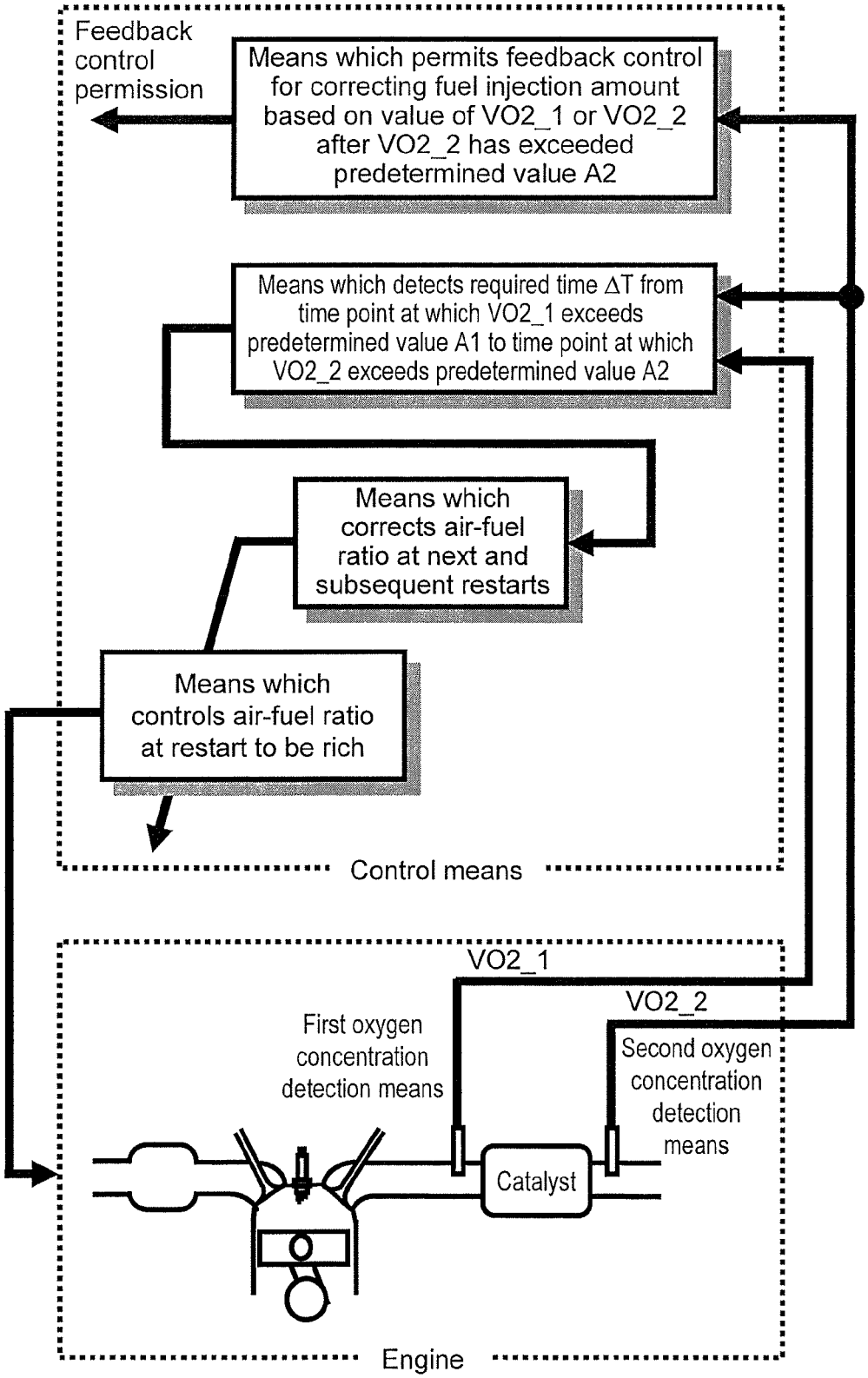
FIG. 13 is a diagram which is used for describing a thirteenth aspect of the control device according to the present invention.
Figure 14:
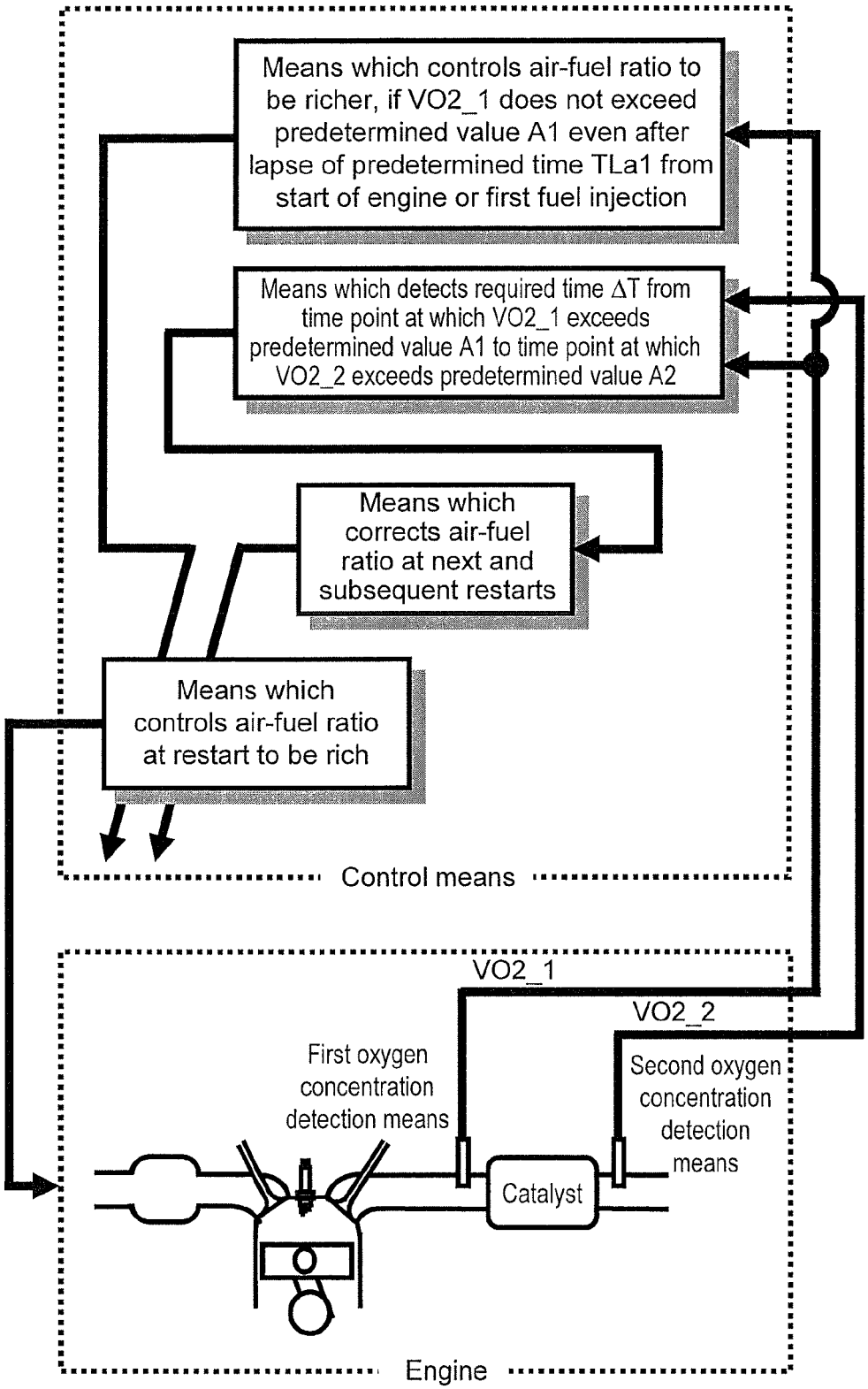
FIG. 14 is a diagram which is used for describing a fourteenth aspect of the control device according to the present invention.
Figure 15:
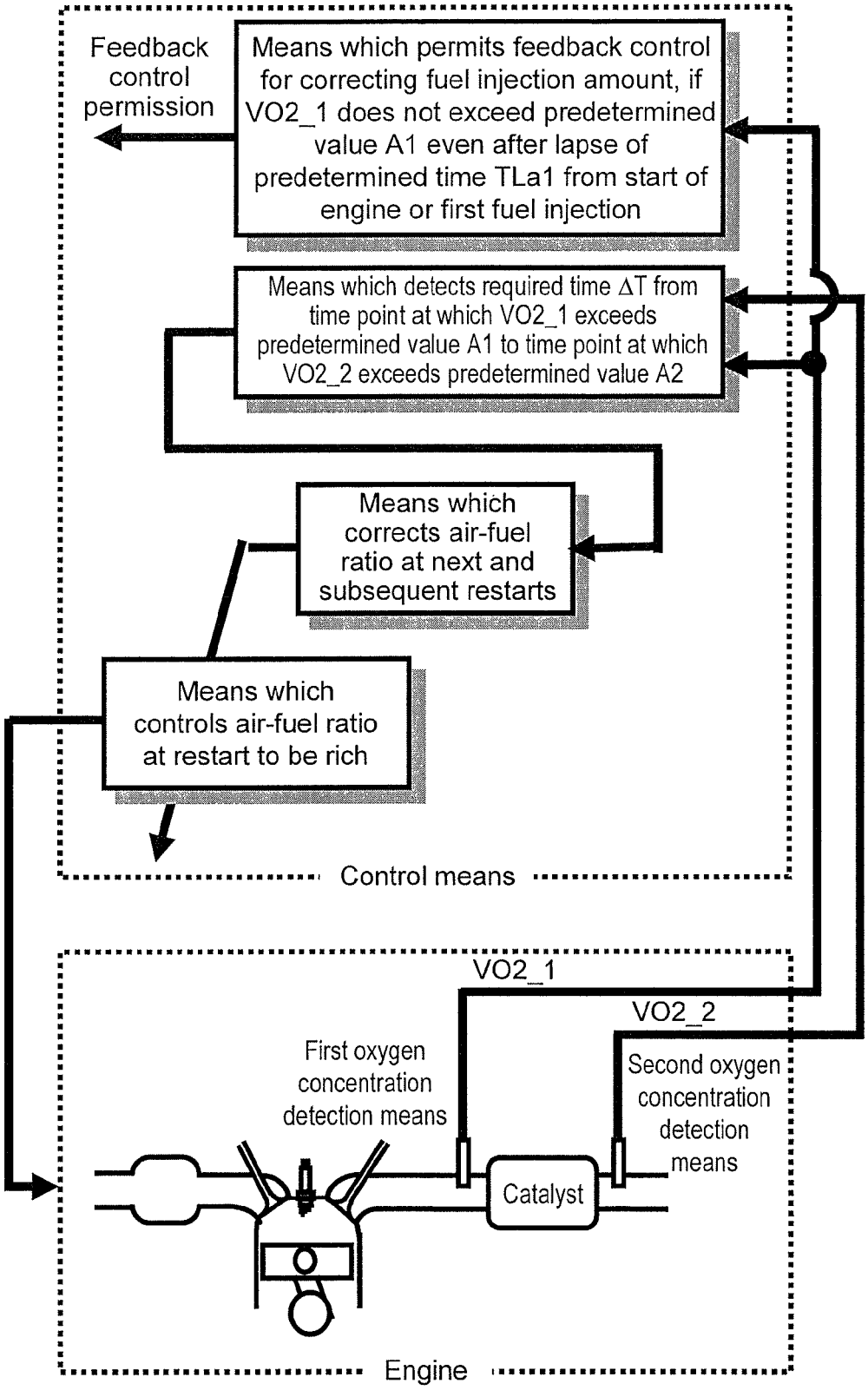
FIG. 15 is a diagram which is used for describing a fifteenth aspect of the control device according to the present invention.
Figure 16:
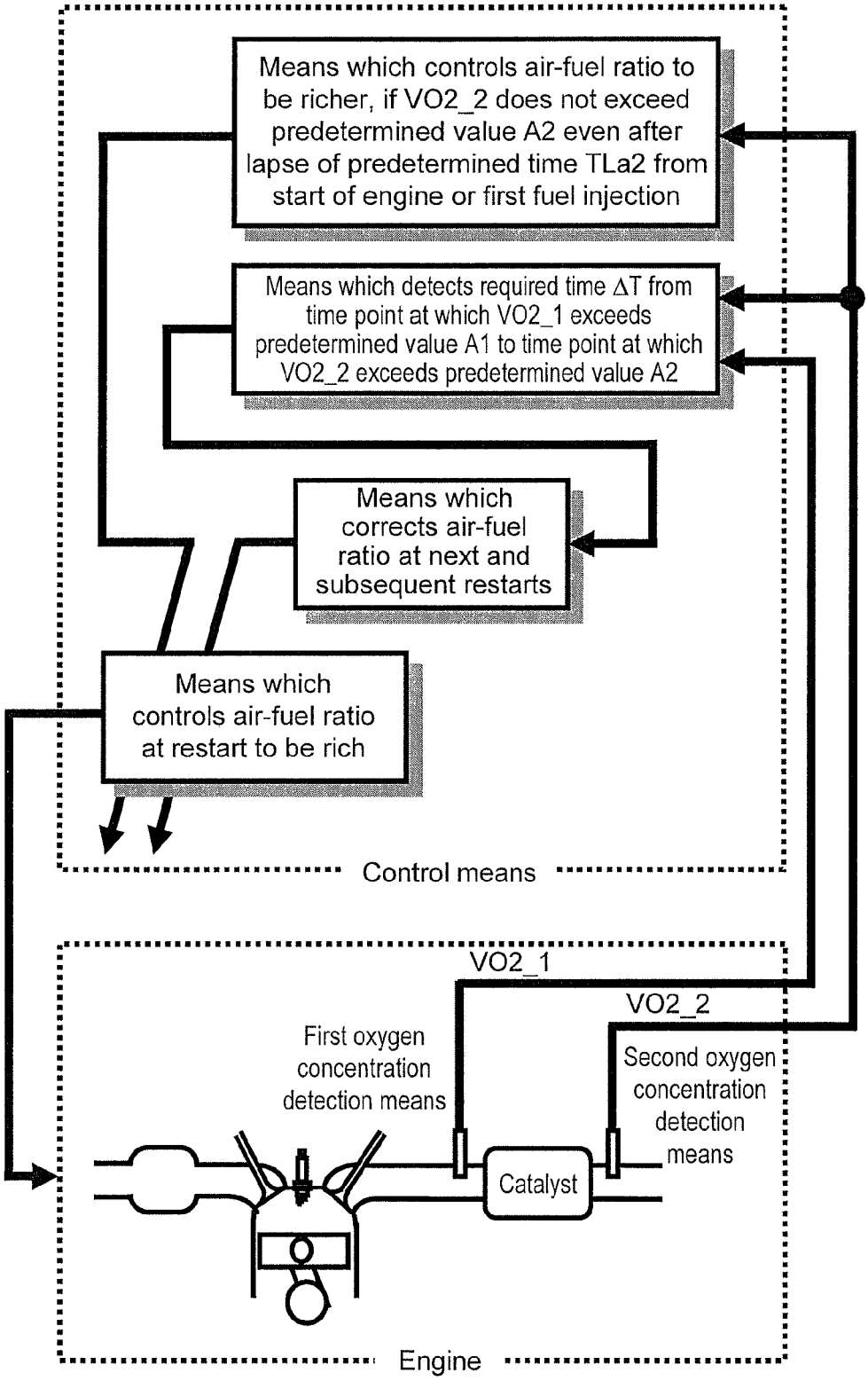
FIG. 16 is a diagram which is used for describing a sixteenth aspect of the control device according to the present invention.
Figure 17:
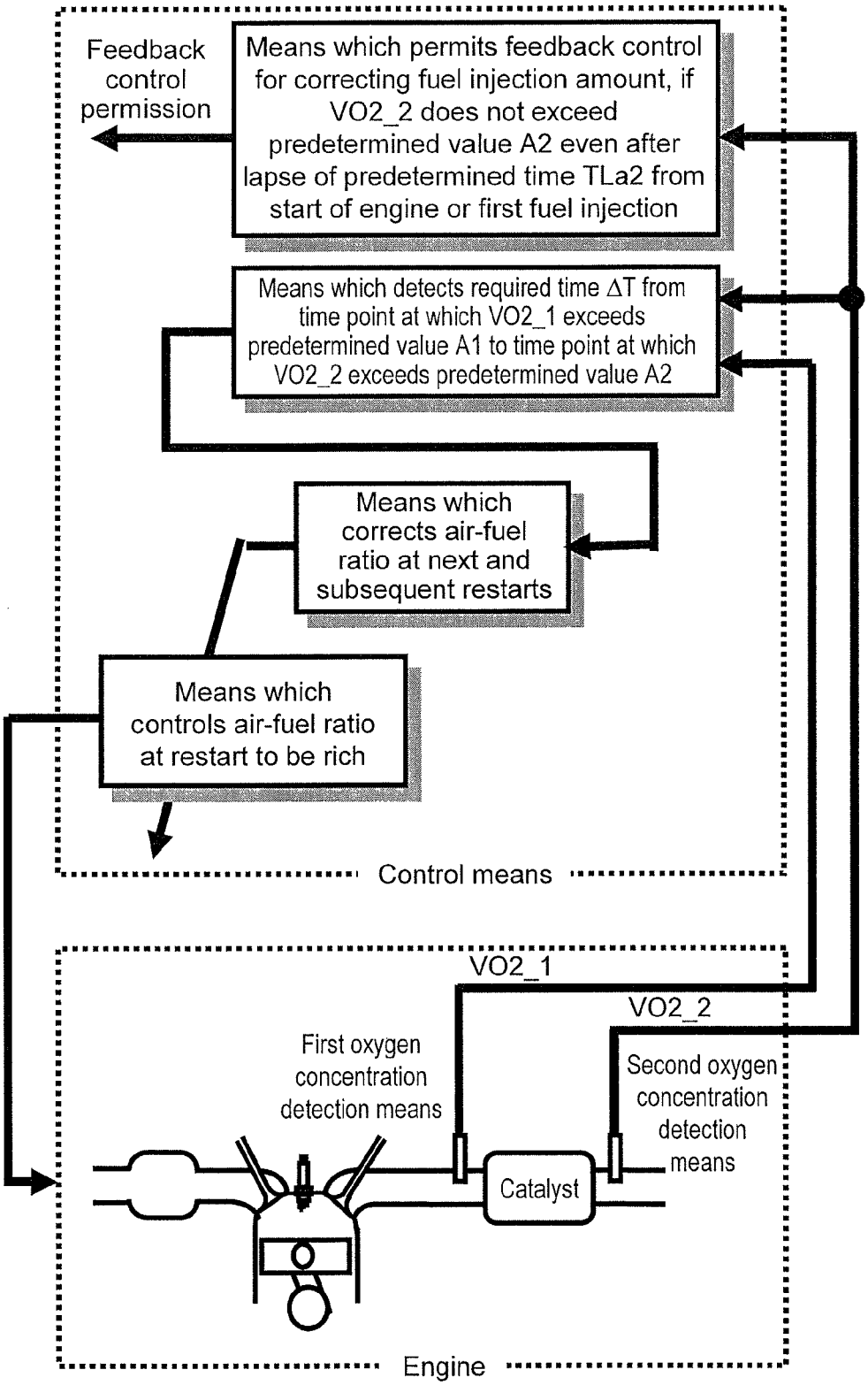
FIG. 17 is a diagram which is used for describing a seventeenth aspect of the control device according to the present invention.
Figure 18:
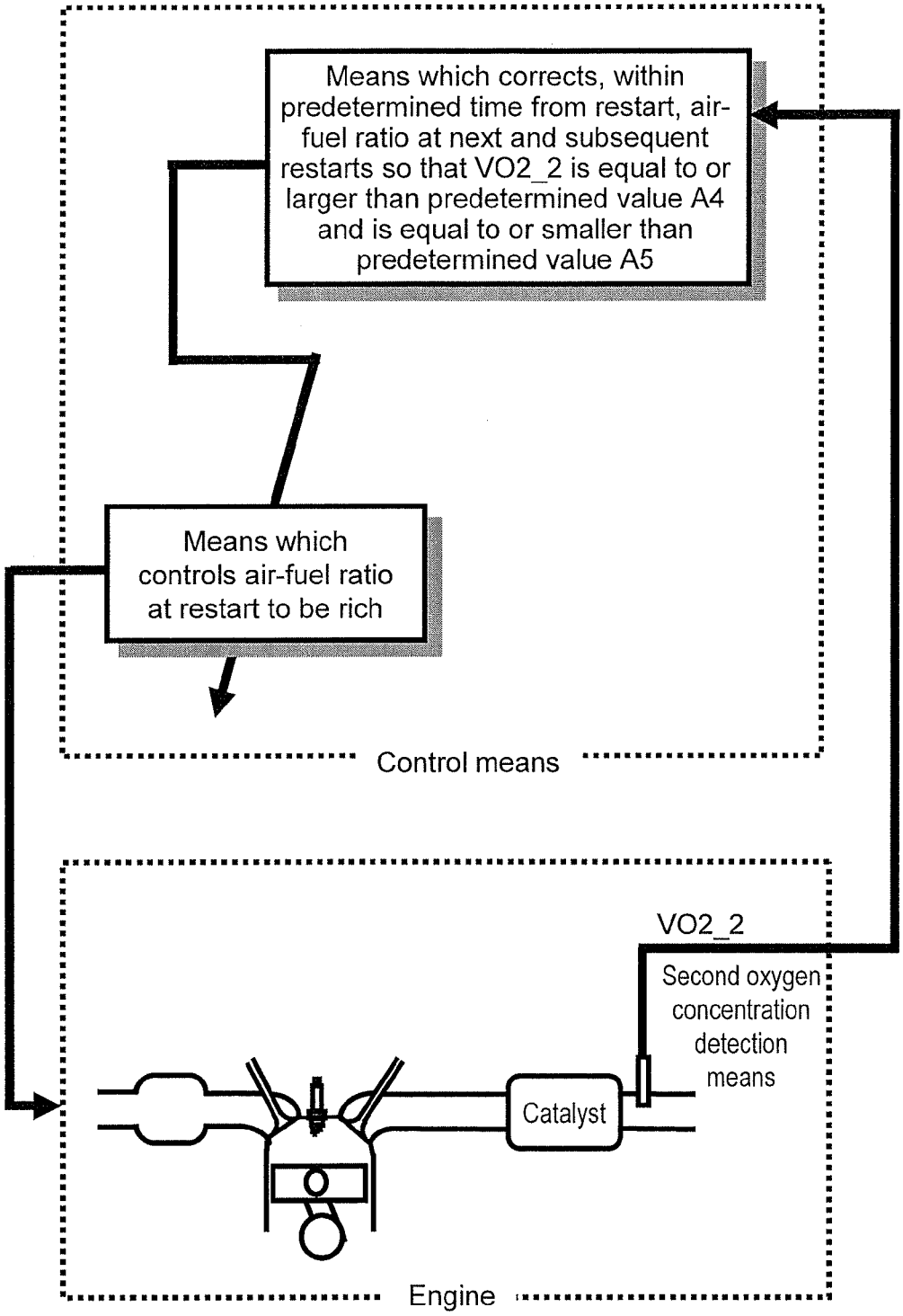
FIG. 18 is a diagram which is used for describing an eighteenth aspect of the control device according to the present invention.
Figure 19:
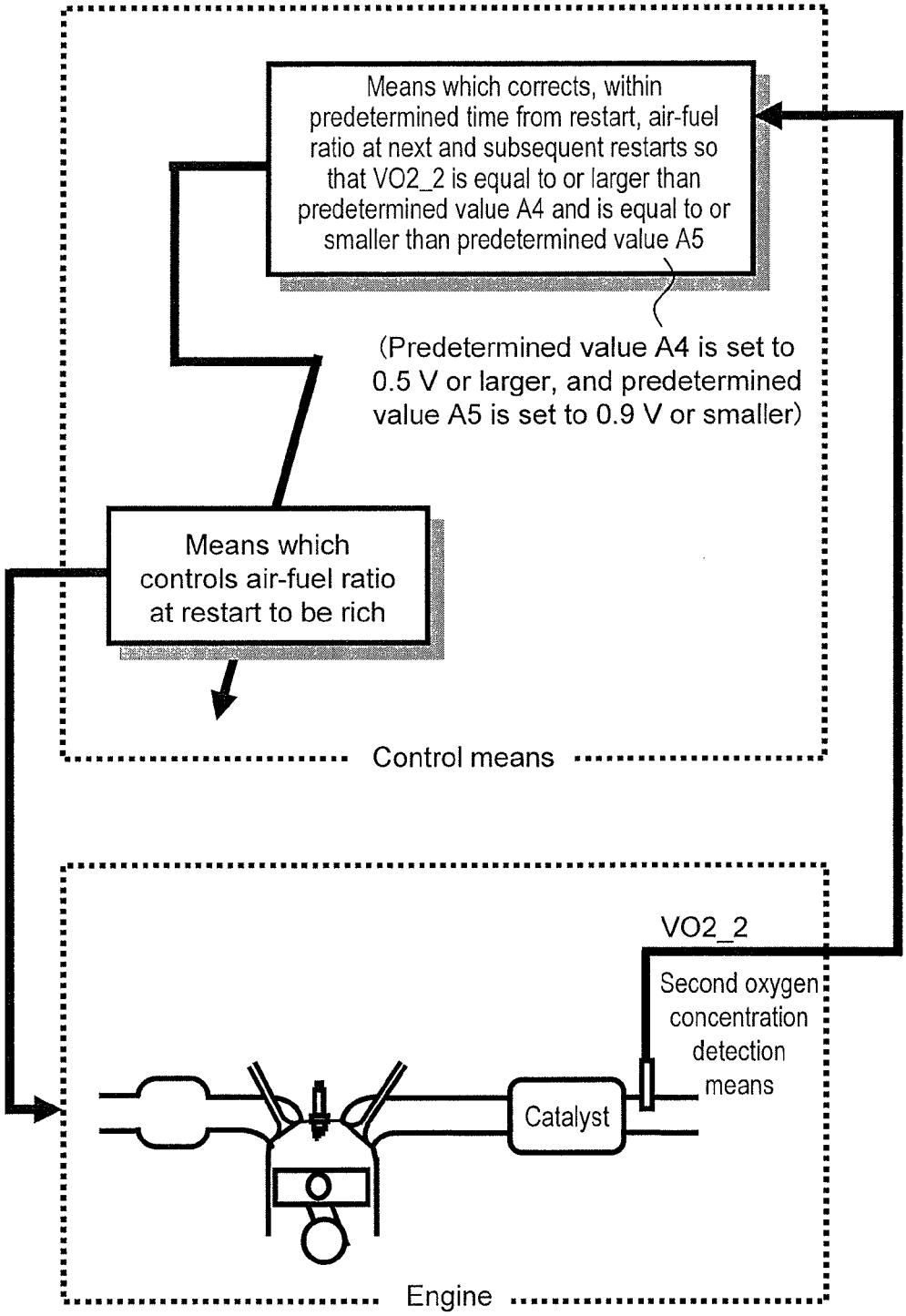
FIG. 19 is a diagram which is used for describing a nineteenth aspect of the control device according to the present invention.

2 air flow sensor
3 electrically controlled throttle
7 fuel injection valve
8 spark plug
9 engine (main body)
11 three-way catalyst
12 catalyst upstream O2 sensor
15 engine speed sensor
17 throttle opening degree sensor
20 catalyst downstream O2 sensor
100 control unit
120 basic fuel injection amount calculation means
130 starting fuel injection amount correction value calculation means
131 rich control permission flag calculation means
132 rich correction value calculation means
135 rich correction value update direction flag calculation means
140 normal-time air-fuel ratio feedback control means
235 rich correction value update direction flag calculation means
332 rich correction value calculation means

335 rich correction value update direction flag calculation means

430 starting fuel injection amount correction value calculation means

432 rich correction value calculation means

435 rich correction value update direction flag calculation means

BEST MODE FOR CARRYING OUT THE INVENTION

Hereinafter, embodiments of a control device for an engine according to the present invention are described with reference to the drawings.

Figure 20:
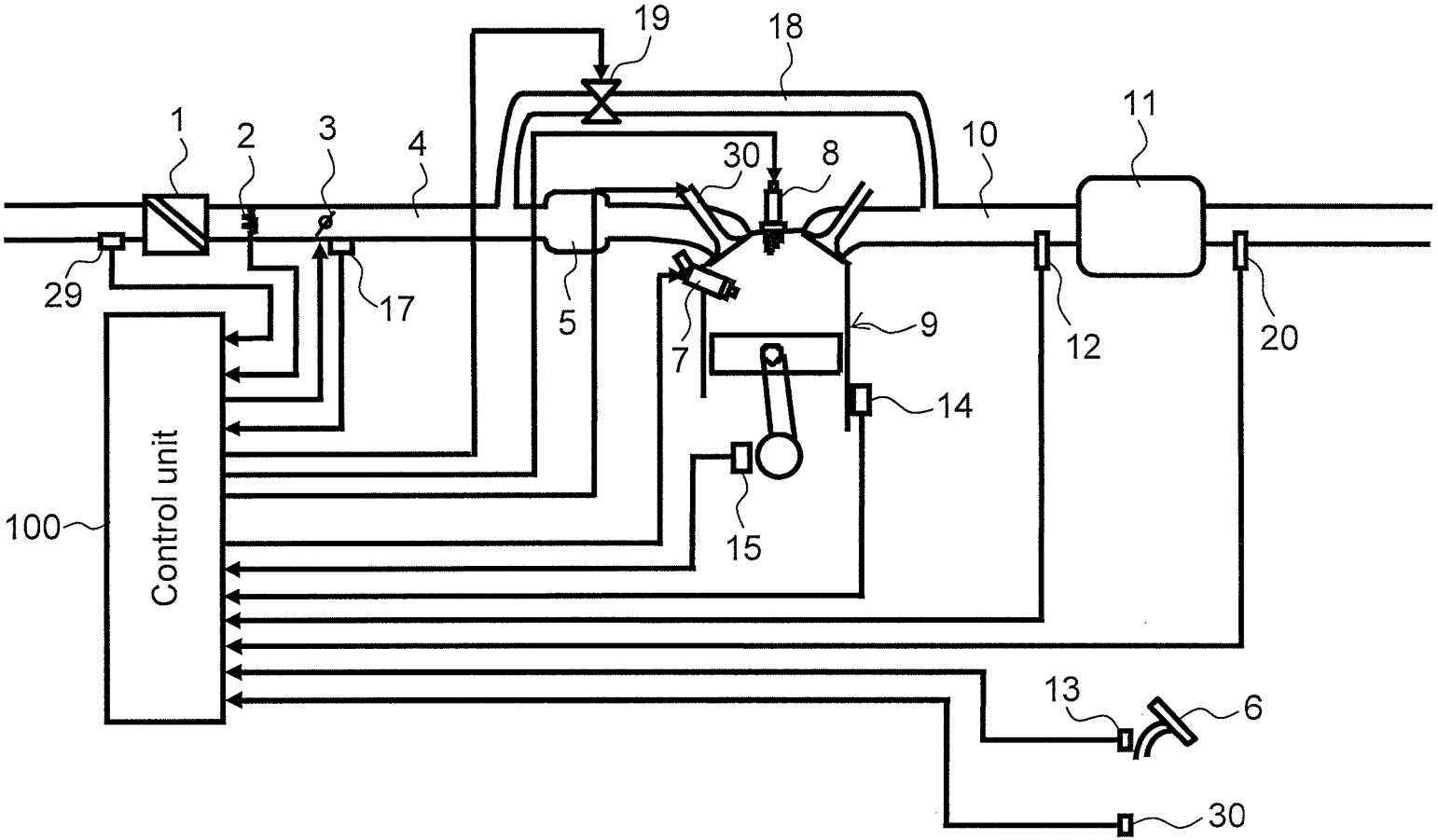
FIG. 20 is a schematic configuration diagram illustrating embodiments (first to fourth embodiments) of the control device according to the present invention, together with an engine to which each embodiment is applied.

FIG. 20 is a schematic configuration diagram illustrating the embodiments (common to first to fourth embodiments) of the control device for the engine according to the present invention, together with an example of an in-vehicle engine to which each embodiment is applied.

In FIG. 20, in a multicylinder engine 9, air from the outside passes through an air cleaner 1, and flows into a cylinder via an intake manifold 4 and a collector 5. An inflow air amount is adjusted by an electrically controlled throttle 3. An air flow sensor 2 detects the inflow air amount. In addition, an intake temperature sensor 29 detects an intake temperature. A crank angle sensor 15 outputs a signal for each 10-degree rotation angle of a crankshaft and a signal for each combustion cycle. A water temperature sensor 14 detects a cooling water temperature for the engine. In addition, an accelerator opening degree sensor 13 detects a depressed amount of an accelerator 6, to thereby detect a torque required by a driver. A vehicle speed sensor 30 detects a vehicle speed.

Respective signals (outputs) from the accelerator opening degree sensor 13, the air flow sensor 2, the intake temperature sensor 29, a throttle opening degree sensor 17 attached to the electrically controlled throttle 3, the crank angle sensor 15, the water temperature sensor 14, and the vehicle speed sensor 30 are sent to a control unit 100 to be described later, and an operation state of the engine is obtained on the basis of these outputs from the sensors, so that principal operation amounts of the engine, such as an air amount, a fuel injection amount, and ignition timing are calculated to be optimized.

The fuel injection amount calculated by the control unit 100 is converted into an opening valve pulse signal to be sent to a fuel injection valve (injector) 7. In addition, a drive signal is sent to a spark plug 8 so that the engine is ignited at the ignition timing calculated by the control unit 100.

Injected fuel is mixed with the air from the intake manifold, and flows into the cylinder of the engine 9, to thereby form a mixture gas. The mixture gas explodes due to sparks generated by the spark plug 8 at predetermined ignition timing, a piston is pushed down by the combustion pressure, and this serves as a power of the engine. Exhaust after the explosion passes through an exhaust manifold 10 to be fed into a three-way catalyst 11. Part of the exhaust passes through an exhaust back-flow pipe 18 to flow back to the intake side. The back-flow amount is controlled by a valve 19.

A catalyst upstream O2 sensor 12 is attached between the engine (main body) 9 and the three-way catalyst 11. A catalyst downstream O2 sensor 20 is attached downstream of the three-way catalyst 11. Normally, the control unit 100 uses output signals from the two sensors 12 and 20, to thereby perform air-fuel ratio feedback control in which the fuel injection amount or the air amount is corrected as appropriate so that the purification efficiency of the three-way catalyst 11 is optimized. On the other hand, at the restart after an idle stop, the control unit 100 performs control based on the present invention (to be described in detail later).

Figure 21:
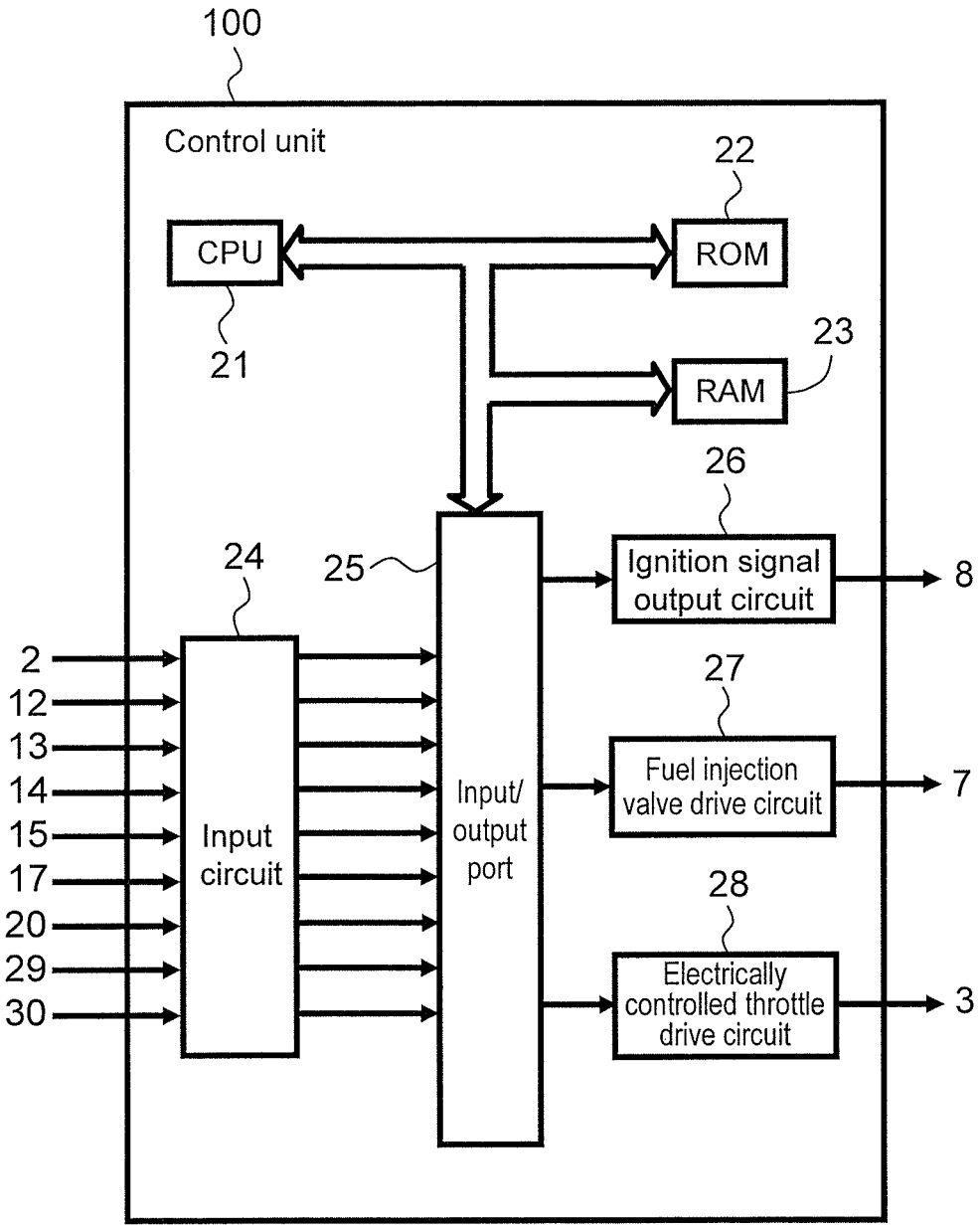
FIG. 21 is an internal configuration diagram illustrating a control unit according to the embodiments (first to fourth embodiments).

FIG. 21 illustrates an internal configuration of the control unit 100. The output values of the respective sensors of the air flow sensor 2, the catalyst upstream O2 sensor 12, the accelerator opening degree sensor 13, the water temperature sensor 14, the engine speed sensor 15, the throttle valve opening degree sensor 17, the catalyst downstream O2 sensor 20, the intake temperature sensor 29, and the vehicle speed sensor 30 are inputted to the control unit 100, are subjected to signal processing such as denoising by an input circuit 24, and then are sent to an input/output port 25. The values at the input port are stored in a RAM 23, and are subjected to arithmetic processing by a CPU 21. A control program in which the contents of the arithmetic processing are described is written in the ROM 22 in advance. Values representing respective actuator operation amounts calculated according to the control program are stored in the RAM 23, and then are sent to the input/output port 25. An ON/OFF signal, which becomes ON when a current is allowed to flow in a primary coil within an ignition output circuit and becomes OFF when a current is not allowed to flow therein, is set as the actuation signal for the spark plug. The ignition timing is a timing at which the transition is made from ON to OFF. The signal for the spark plug which is set at the output port is amplified by an ignition output circuit 26 so as to have sufficient energy necessary for the combustion, and then is supplied to the spark plug. In addition, an ON/OFF signal, which becomes ON when the valve is opened and becomes OFF when the valve is closed, is set as the drive signal for the fuel injection valve. This ON/OFF signal is amplified by a fuel injection valve drive circuit 27 so as to have sufficient energy necessary to open the fuel injection valve, and then is sent to the fuel injection valve 7. The drive signal for realizing a target opening degree of the electrically controlled throttle 3 is sent to the electrically controlled throttle 3 via an electrically controlled throttle drive circuit 28.

Next, the contents of processing performed by the control unit 100 are specifically described for each embodiment.

First Embodiment

Figure 22:
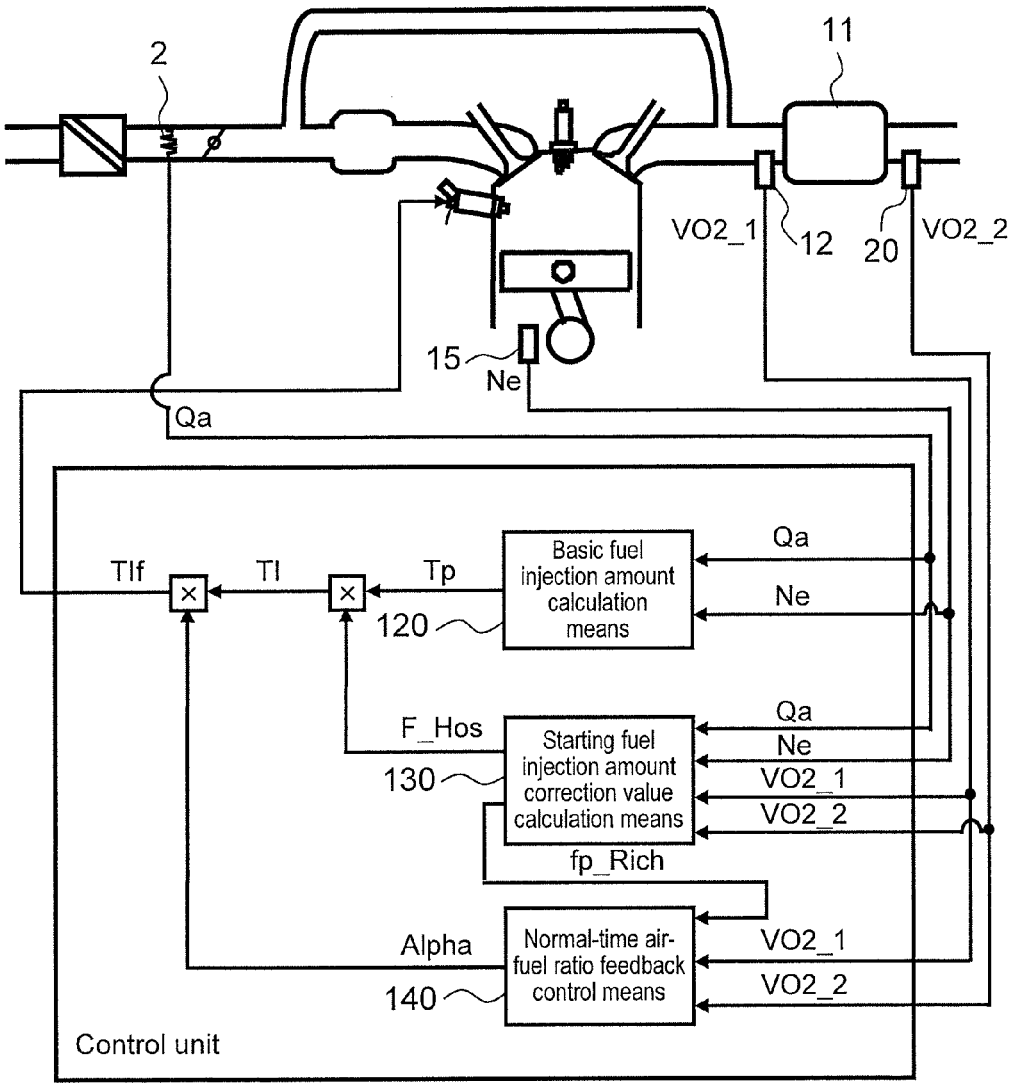
FIG. 22 is a diagram illustrating a control system according to the first to fourth embodiments.

FIG. 22 is a diagram illustrating a control system according to the first embodiment (common to the second to fourth embodiments). The control device according to the respective embodiments includes the following calculation means and control means.

Figure 23:
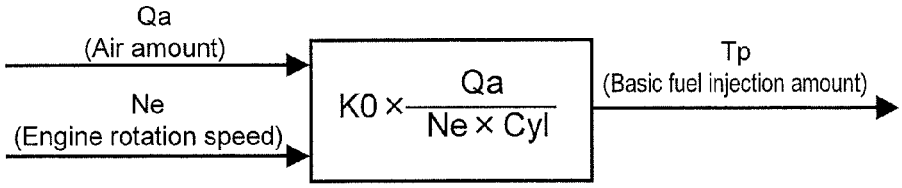
FIG. 23 is a diagram which is used for describing basic fuel injection amount calculation means according to the first to fourth embodiments.
Figure 24:
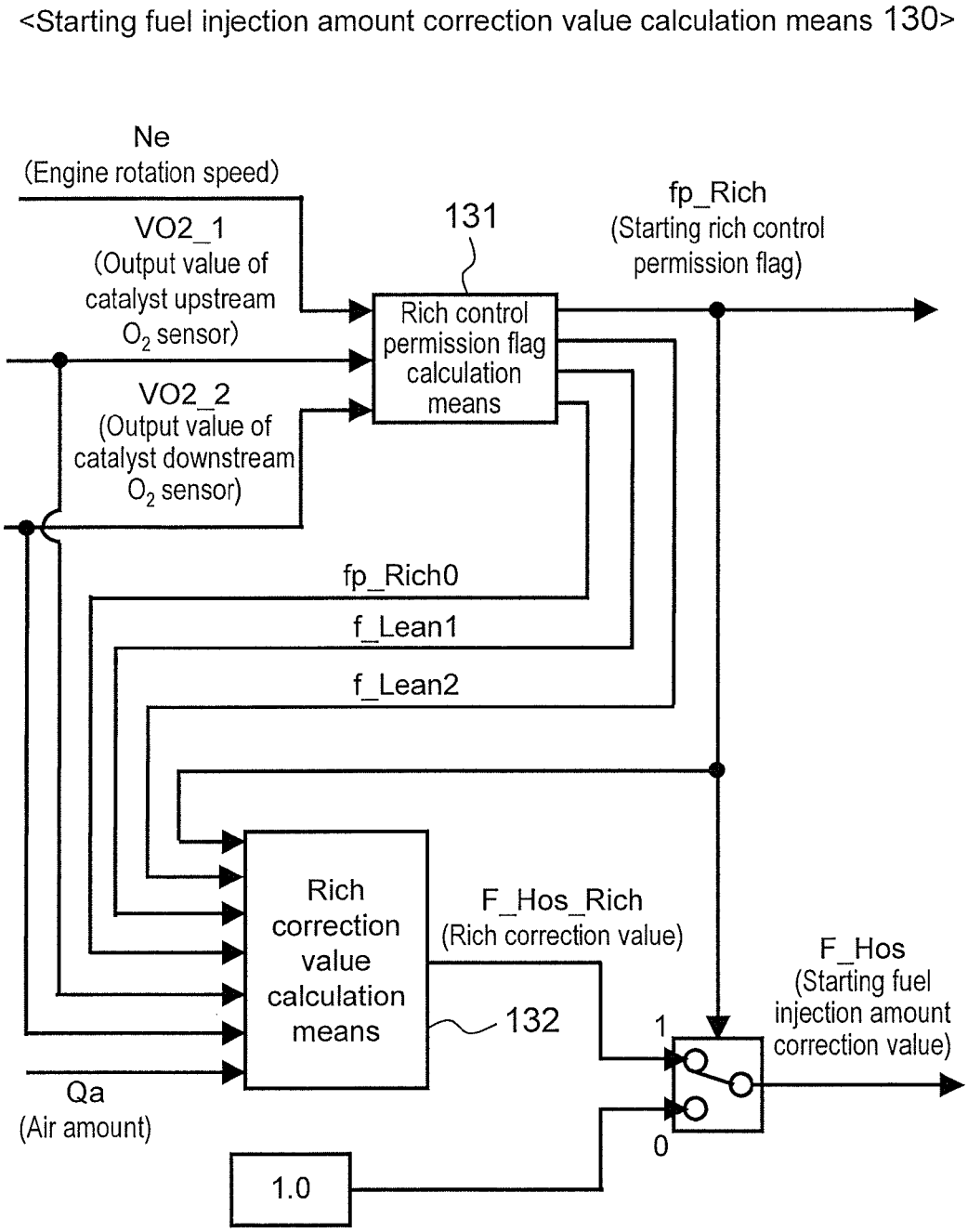
FIG. 24 is a diagram which is used for describing starting fuel injection amount correction value calculation means according to the first to third embodiments.
Figure 25:
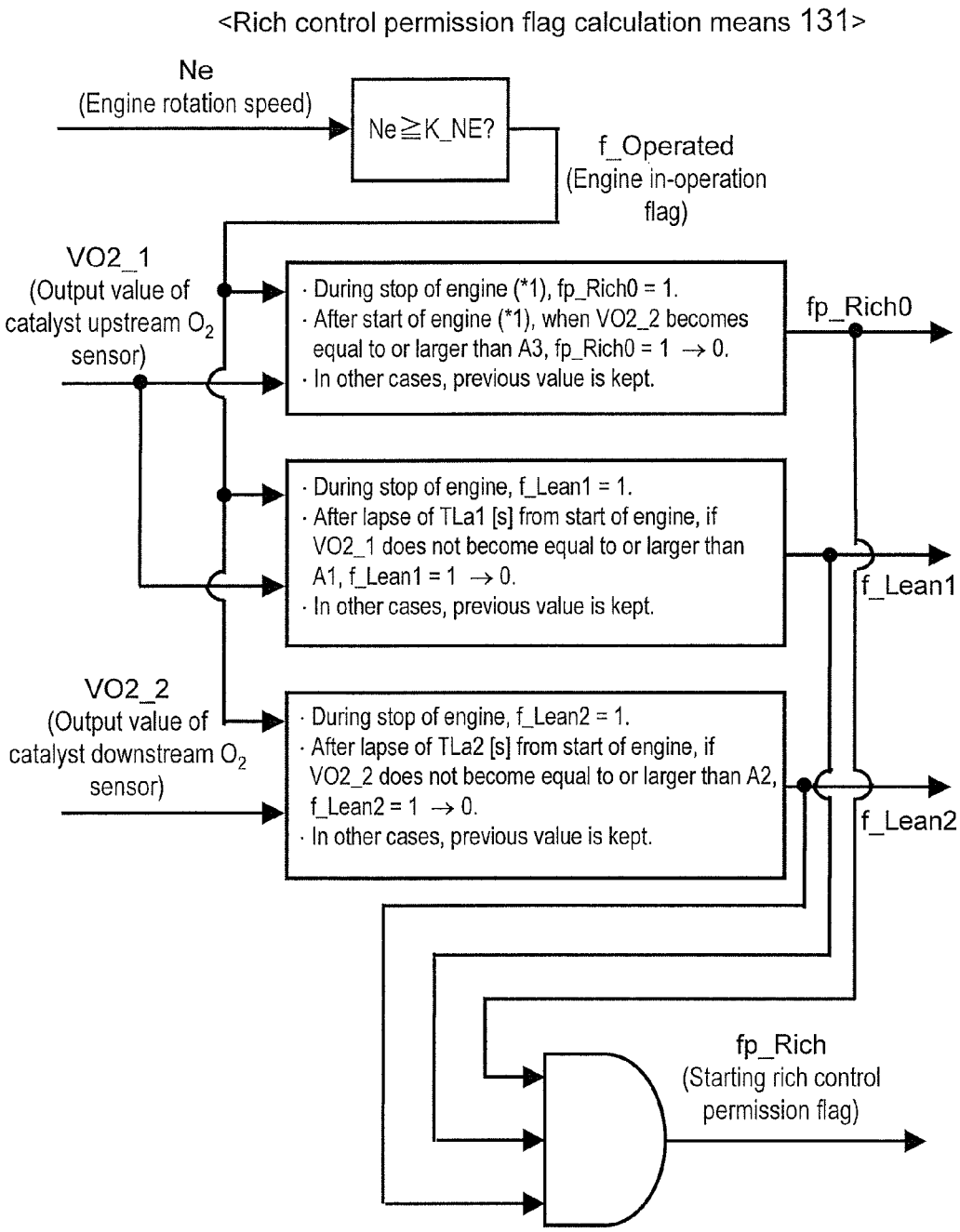
FIG. 25 is a diagram which is used for describing rich control permission flag calculation means according to the first to fourth embodiments.

Basic fuel injection amount calculation means 120 (FIG. 23)

Starting fuel injection amount correction value calculation means 130 (FIG. 24 to FIG. 27)

Figure 28:
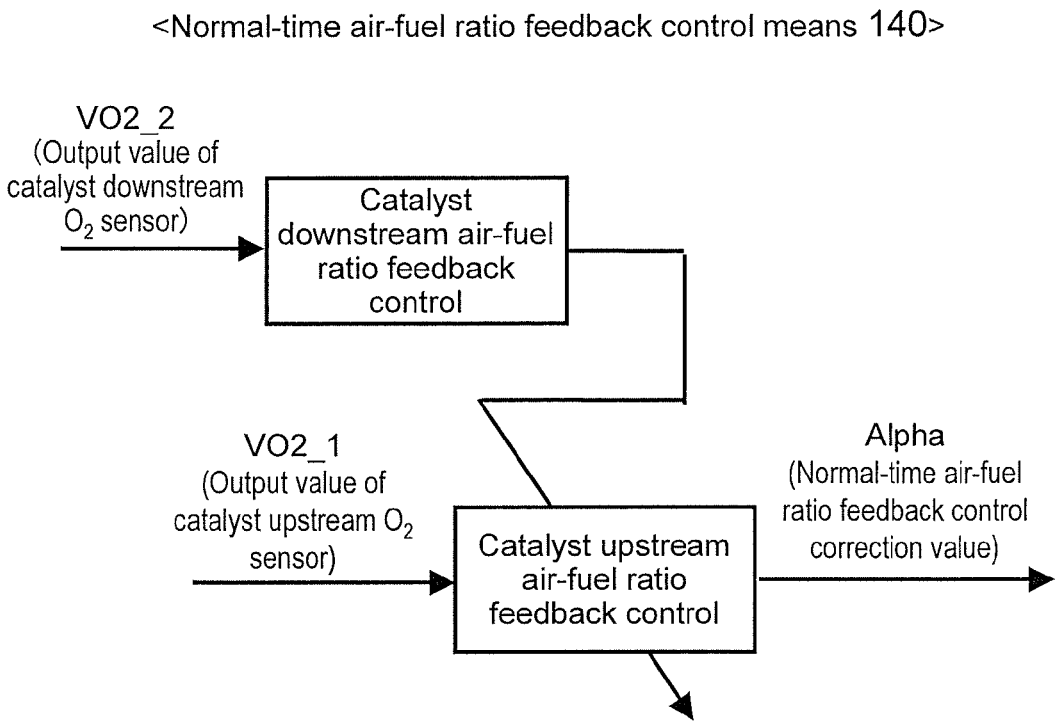
FIG. 28 is a diagram which is used for describing normal-time air-fuel ratio feedback control means according to the first to fourth embodiments.

Normal-time air-fuel ratio feedback control means 140 (FIG. 28)

In the present embodiment, the basic fuel injection amount calculation means 120 calculates a basic fuel injection amount (Tp). The starting fuel injection amount correction value calculation means 130 uses output values (VO2_1 and VO2_2) of the O2 sensors 12 and 20 upstream and downstream of the catalyst 11, to thereby calculate a value (F_Hos) for correcting the fuel injection amount so that the air-fuel ratio at the restart of the engine is optimized. F_Hos is corrected for each restart so as to approach the optimal air-fuel ratio. After the end of the air-fuel ratio correction control at the restart by the starting fuel injection amount correction value calculation means 130, the basic fuel injection amount is corrected by a correction value (Alpha) calculated by the normal-time air-fuel ratio feedback control means 140.

Hereinafter, the details of the respective calculation means (control means) are described.

<Basic Fuel Injection Amount Calculation Means 120 (FIG. 23)>

This calculation means 120 calculates the basic fuel injection amount (Tp). Specifically, this calculation is performed on the basis of an expression illustrated in FIG. 23. Here, Cyl represents the number of cylinders. K0 is decided on the basis of specifications of the injector (the relation between a fuel injection pulse width and the fuel injection amount).

<Starting Fuel Injection Amount Correction Value Calculation Means 130 (FIG. 24)>

This calculation means 130 calculates the starting fuel injection amount correction value (F_Hos). This is specifically illustrated in FIG. 24.

Rich control permission flag calculation means 131 (to be described later) calculates a starting rich control permission flag (fp_Rich) and respective flags of fp_Rich0, f_Lean1, and f_Lean2, on the basis of an engine rotation speed (Ne), the output value (VO2_1) of the catalyst upstream O2 sensor, and the output value (VO2_2) of the catalyst downstream O2 sensor.

Rich correction value calculation means 132 (to be described later) calculates a rich correction value (F_Hos_Rich) on the basis of the output value (VO2_1) of the catalyst upstream O2 sensor, the output value (VO2_2) of the catalyst downstream O2 sensor, an air amount (Qa), the starting rich control permission flag (fp_Rich), and the respective flags of fp_Rich0, f_Lean1, and f_Lean2.

When the starting rich control permission flag (fp_Rich) is 1, a value of the rich correction value (F_Hos_Rich) is used as the starting fuel injection amount correction value (F_Hos). When the starting rich control permission flag (fp_Rich) is 0, the starting fuel injection amount correction value (F_Hos) is set to 1.0 (the basic fuel injection amount is not corrected).

<Rich Control Permission Flag Calculation Means 131 (FIG. 25)>

This calculation means 131 calculates the starting rich control permission flag (fp_Rich) and the respective flags of fp_Rich0, f_Lean1, and f_Lean2. This is specifically illustrated in FIG. 25.

When the engine rotation speed (Ne) is equal to or larger than K_NE, it is determined that the engine is in operation (the engine is not stopped), so that an engine in-operation flag (f_Operated) is set to 1.

During the stop of the engine (when f_Operated=0), setting is made so that fp_Rich0=1. After the start of the engine (after a change is made so that f_Operated=0→1), when VO2_2 becomes equal to or larger than A3, a change is made so that fp_Rich0=1→0. In other cases, the previous value is kept. A3 is set to, for example, 0.7 [V].

During the stop of the engine (when f_Operated=0), setting is made so that f_Lean1=1. After a lapse of TLa1 [s] from the start of the engine, if VO2_1 does not become equal to or larger than A1, a change is made so that f_Lean1=1→0. In other cases, the previous value is kept. TLa1 is set by a rough indication based on a period of time from the first fuel injection until the catalyst upstream O2 sensor detects exhaust generated by the first combustion. A1 is set to, for example, 0.9 [V].

During the stop of the engine (when f_Operated=0), setting is made so that f_Lean2=1. After a lapse of TLa2 [s] from the start of the engine, if VO2_2 does not become equal to or larger than A2, a change is made so that f_Lean2=1→0. In other cases, the previous value is kept. TLa2 is set by a rough indication based on a period of time from the first fuel injection until the catalyst downstream O2 sensor detects exhaust generated by the first combustion. A2 is set to, for example, 0.9 [V].

When fp_Rich0=1, f_Lean1=1, and f_Lean2=1, the starting rich control permission flag (fp_Rich) is set to 1. In other cases, the starting rich control permission flag (fp_Rich) is set to 0.

<Rich Correction Value Calculation Means 132 (FIG. 26)>

Figure 26:
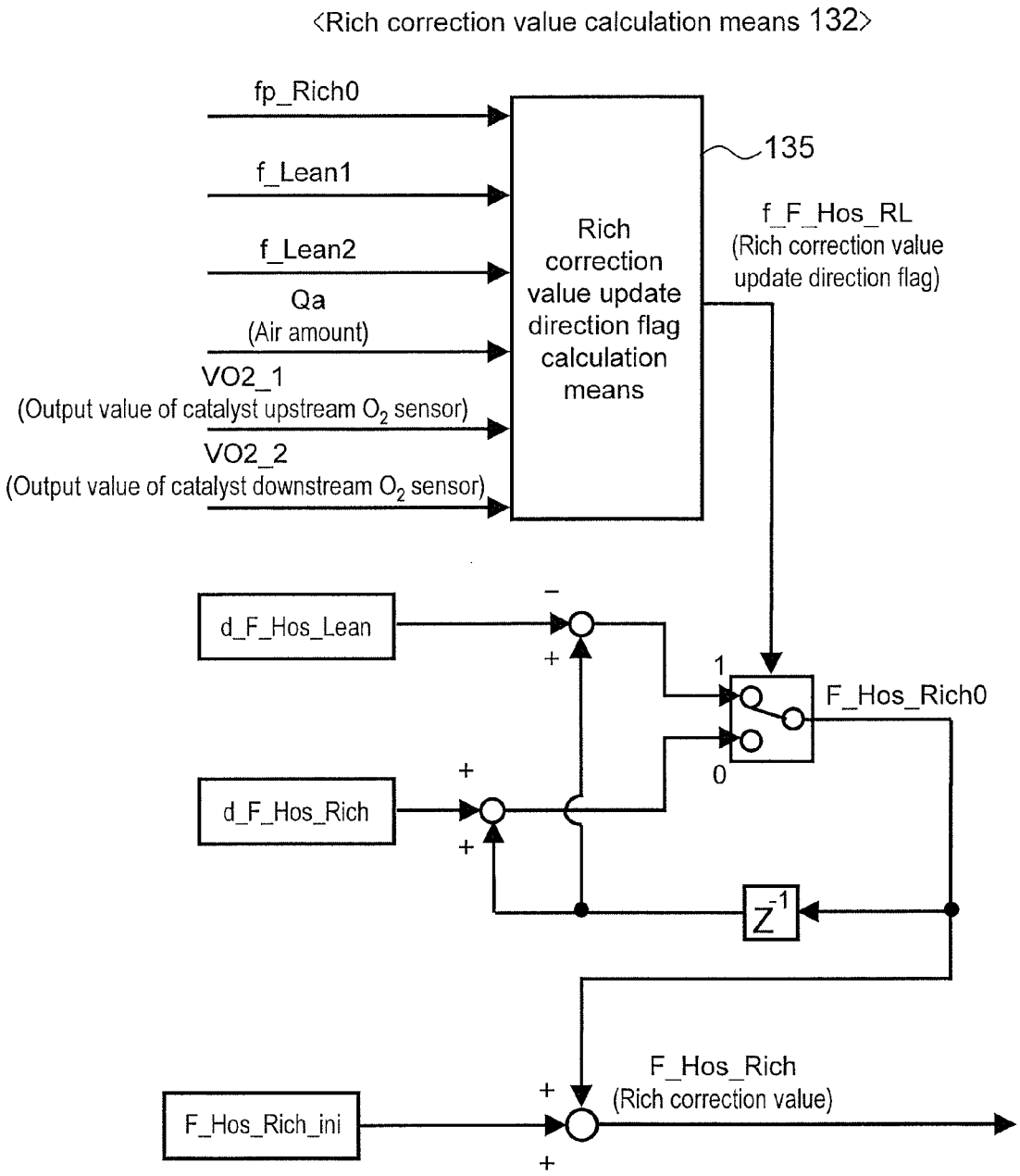
FIG. 26 is a diagram which is used for describing rich correction value calculation means according to the first and second embodiments.
Figure 27:
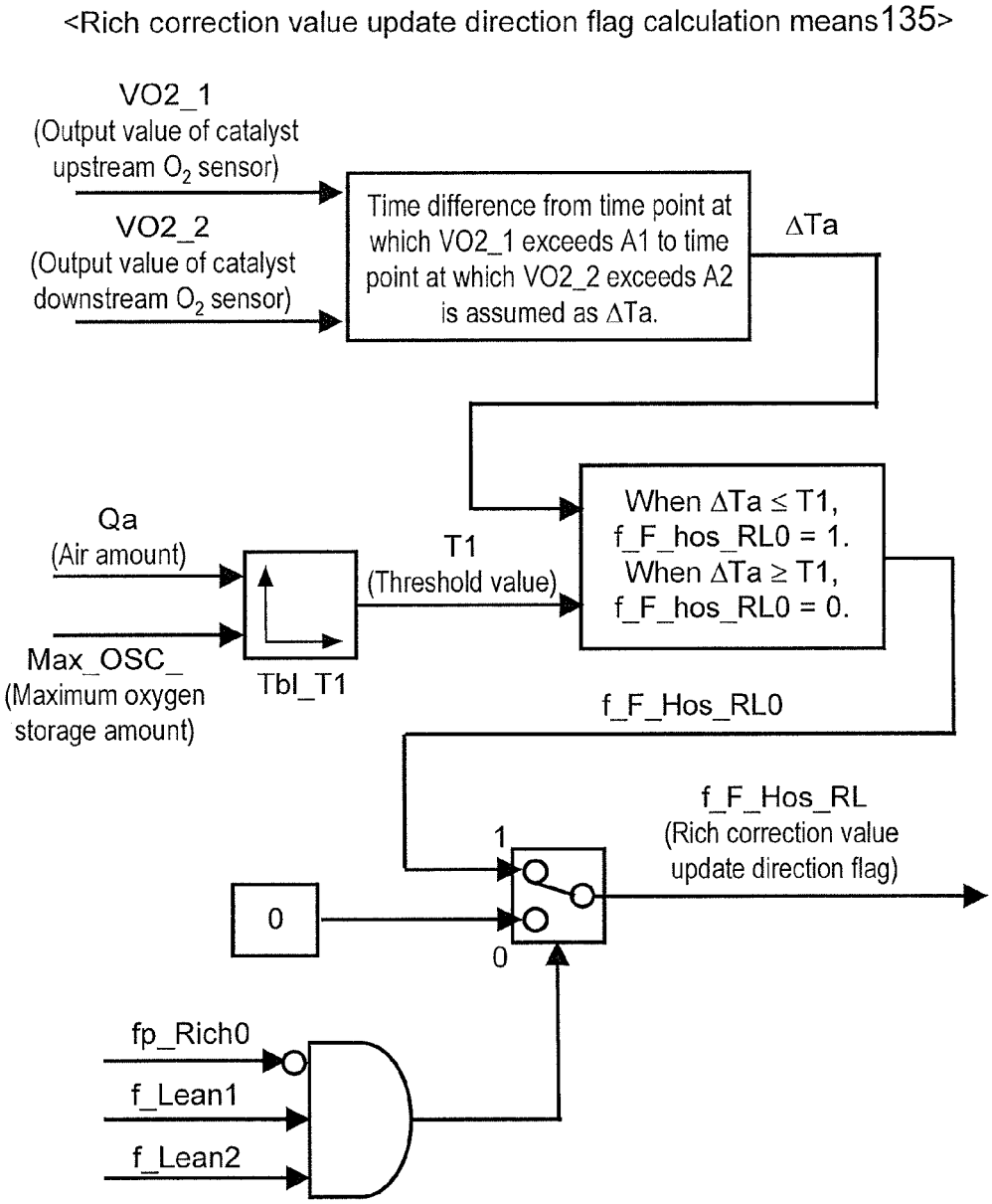
FIG. 27 is a diagram which is used for describing rich correction value update direction flag calculation means according to the first embodiment.

This calculation means 132 calculates the rich correction value (F_Hos_Rich). When the starting rich control permission flag (fp_Rich) changes from 1→0, as illustrated in FIG. 26, this calculation means 132 is implemented, whereby the rich correction value (F_Hos_ich) is updated. In other cases, the previous value is kept as the rich correction value (F_Hos_Rich).

Rich correction value update direction flag calculation means 135 (to be described later) calculates a rich correction value update direction flag (f_F_Hos_RL) on the basis of the output value (VO2_1) of the catalyst upstream O2 sensor, the output value (VO2_2) of the catalyst downstream O2 sensor, the air amount (Qa), and the respective flags of fp_Rich0, f_Lean1, and f_Lean2.

When the rich correction value update direction flag (f_F_Hos_RL) is 1, a value obtained by subtracting d_F_Hos_Lean from the previous value of F_Hos_Rich0 is set as the latest F_Hos_Rich0. When the rich correction value update direction flag (f_F_Hos_RL) is 0, a value obtained by adding d_F_Hos_Rich to the previous value of F_Hos_Rich0 is set as the latest F_Hos_Rich0.

The rich correction value (F_Hos_Rich) is set to a value obtained by adding F_Hos_Rich0 to F_Hos_Rich_ini. F_Hos_Rich_ini is an initial value of the rich correction value (F_Hos_Rich). F_Hos_Rich_ini is set to such a value that can realize a proper rich level in accordance with the characteristics of a target engine by considering a control error of the air-fuel ratio control system at the start and the like. The rich correction values (d_F_Hos_Lean and d_F_Hos_Rich) which are updated for each restart are set in accordance with the characteristics of the target engine and a target catalyst by considering a correction speed and stability (oscillation properties).

<Rich Correction Value Update Direction Flag Calculation Means 135 (FIG. 27)>

This calculation means 135 calculates the rich correction value update direction flag (f_F_Hos_RL). This is specifically illustrated in FIG. 27.

A required time from a time point at which the output value (VO2_1) of the catalyst upstream O2 sensor exceeds A1 to a time point at which the output value (VO2_2) of the catalyst downstream O2 sensor exceeds A2 is assumed as ΔTa.

When ΔTa≦T1, f_F_hos_RL0 is set to 1. When ΔTa≧T1, f_F_hos_RL0 is set to 0.

T1 is obtained by referring to a table (Tbl_T1) on the basis of the air amount (Qa) and a maximum oxygen storage amount (Max_OSC).

When f_Lean1=1 and f_Lean2=1 and when fp_Rich0 changes from 1→0, a value of f_F_hod_RL0 is used as the rich correction value update direction flag (f_F_Hos_RL). In other cases, the rich correction value update direction flag (f_F_Hos_RL) is set to 0.

As described above, when the starting rich control permission flag (fp_Rich) changes from 1→0, the rich correction value calculation means 132 (FIG. 26) implements this calculation means 135, whereby the rich correction value (F_Hos_Rich) is updated. In other cases, the previous value is kept as the rich correction value (F_Hos_Rich). The starting rich control permission flag (fp_Rich) is calculated by the rich control permission flag calculation means 131 (FIG. 25), and in any one of the case where fp_Rich0 changes from 1→0, the case where f_Lean1 changes from 1→0, and the case where f_Lean2 changes from 1→0, the starting rich control permission flag (fp_Rich) changes from 1→0. When fp_Rich0 changes from 1→0, a value of f_F_hod_RL0 is used as the rich correction value update direction flag (f_F_Hos_RL) (whether to perform the rich correction or the lean correction is decided on the basis of a value of ΔTa). When f_Lean1 changes from 1→0 or when f_Lean2 changes from 1→0, the rich correction value update direction flag (f_F_Hos_RL) is set to 0, and the rich correction is performed.

As described above, A1 and A2 are set to, for example, 0.9 [V].

The required time ΔTa has sensitivity to an OSC performance (=maximum oxygen storageable amount) and an intake air amount as well as the actual air-fuel ratio (rich level), and hence the table (Tbl_T1) is used for correction thereof. There are a large number of known technologies concerning a method of obtaining the maximum oxygen storage amount (Max_OSC), and hence the details thereof are not described herein.

<Normal-Time Air-Fuel Ratio Feedback Control Means 140 (FIG. 28)>

This control means 140 calculates the normal-time air-fuel ratio feedback control correction value (Alpha). When the starting rich control permission flag (fp_Rich) is 0 (when starting fuel injection amount correction is not performed), feedback control on the fuel injection amount is performed by this control means 140. This is specifically illustrated in FIG. 28. There are a large number of known technologies concerning "catalyst downstream air-fuel ratio feedback control" and "catalyst upstream air-fuel ratio feedback control", and hence the details thereof are not described herein.

Second Embodiment

In the first embodiment described above, the air-fuel ratio at the next and subsequent restarts is corrected on the basis of only the required time ΔTa from the time point at which the output value of the catalyst upstream O2 sensor 12 exceeds the predetermined value A1 to the time point at which the output value of the catalyst downstream O2 sensor exceeds the predetermined value A2. In a second embodiment, in addition to the required time ΔTa, a required time ΔTb from a time point at which the output value of the catalyst upstream O2 sensor exceeds a predetermined value B1 to a time point at which the output value of the catalyst downstream O2 sensor exceeds a predetermined value B2 is also used, and the air-fuel ratio at the next and subsequent restarts is corrected. Here, it should be noted that A1>B1 and A2>B2.

In the second embodiment, the basic fuel injection amount calculation means 120 (FIG. 23), the starting fuel injection amount correction value calculation means 130 (FIG. 24), the rich control permission flag calculation means 131 (FIG. 25), the rich correction value calculation means 132 (FIG. 26), and the normal-time air-fuel ratio feedback control means 140 (FIG. 28), which are described in the first embodiment, are basically the same as those of the first embodiment, and thus will not be described in detail again.

Hereinafter, rich correction value update direction flag calculation means 235, which is different from that of the first embodiment, is described.

Figure 29:
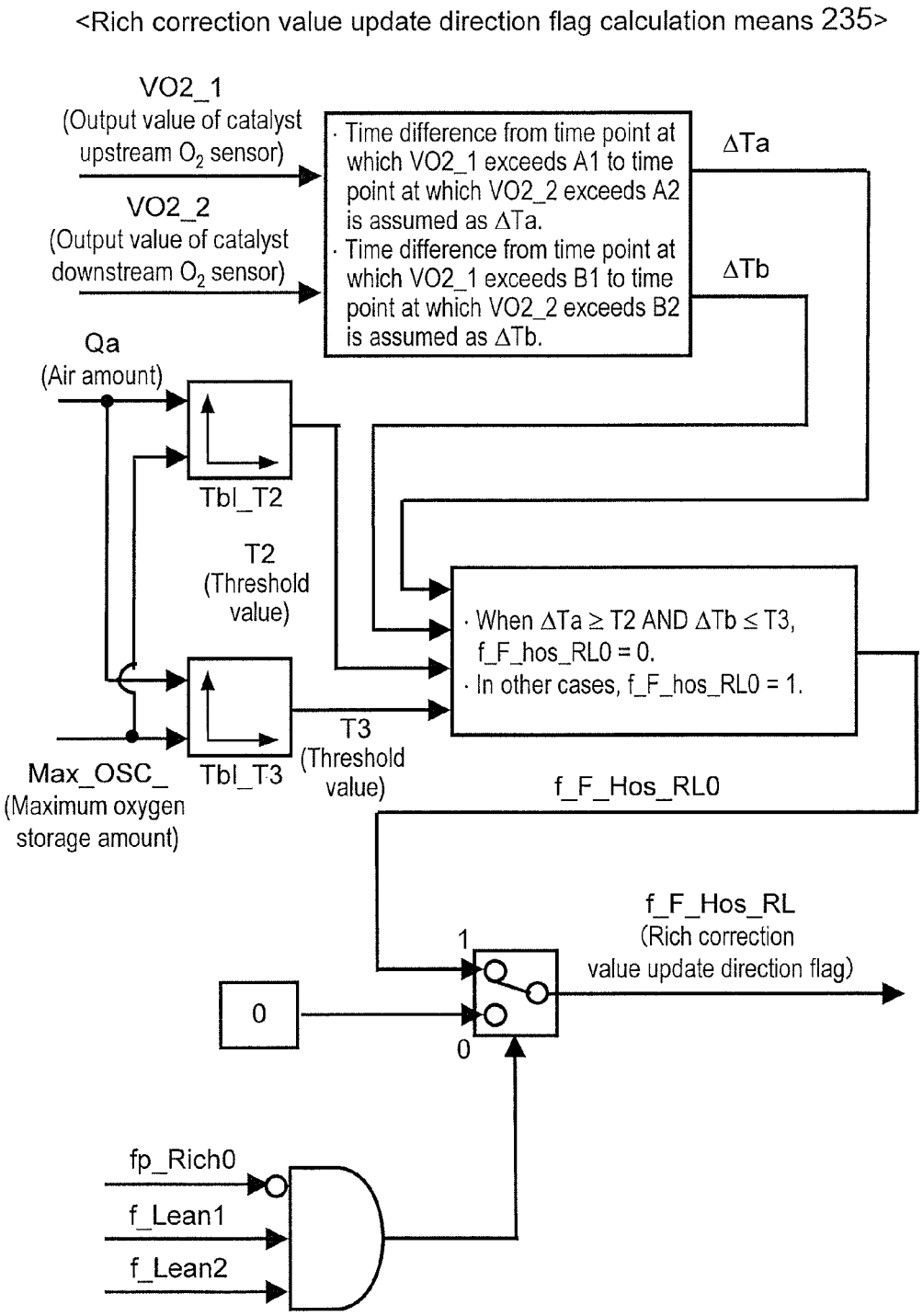
FIG. 29 is a diagram which is used for describing rich correction value update direction flag calculation means according to the second embodiment.

<Rich Correction Value Update Direction Flag Calculation Means 235 (FIG. 29)>

This calculation means 235 calculates the rich correction value update direction flag (f_F_Hos_RL). This is specifically illustrated in FIG. 29.

The required time from the time point at which the output value (VO_1) of the catalyst upstream O2 sensor exceeds A1 to the time point at which the output value (VO_2) of the catalyst downstream O2 sensor exceeds A2 is assumed as ΔTa.

The required time from the time point at which the output value (VO_1) of the catalyst upstream O2 sensor exceeds B1 to the time point at which the output value (VO_2) of the catalyst downstream O2 sensor exceeds B2 is assumed as ΔTb.

When ΔTa≧T2 and ΔTb≦T3, f_F_hos_RL0 is set to 0. In other cases, f_F_hos_RL0 is set to 1.

T2 and T3 are obtained by referring to a table (Tbl_T2) and a table (Tbl_T3) on the basis of the air amount (Qa) and the maximum oxygen storage amount (Max_OSC).

When f_Lean1=1 and f_Lean2=1 and when fp_Rich0 changes from 1→0, a value of f_F_hod_RL0 is used as the rich correction value update direction flag (f_F_Hos_RL). In other cases, the rich correction value update direction flag (f_F_Hos_RL) is set to 0.

As described above, when the starting rich control permission flag (fp_Rich) changes from 1→0, the rich correction value calculation means 132 (FIG. 26) implements this calculation means 235, whereby the rich correction value (F_Hos_Rich) is updated. In other cases, the previous value is kept as the rich correction value (F_Hos_Rich). The starting rich control permission flag (fp_Rich) is calculated by the "rich control permission flag calculation means (FIG. 25)", and in any one of the case where fp_Rich0 changes from 1→0, the case where f_Lean1 changes from 1→0, and the case where f_Lean2 changes from 1→0, the starting rich control permission flag (fp_Rich) changes from 1→0. When fp_Rich0 changes from 1→0, a value of f_F_hod_RL0 is used as the rich correction value update direction flag (f_F_Hos_RL) (whether to perform the rich correction or the lean correction is decided on the basis of a value of ΔTa). When f_Lean1 changes from 1→0 or when f_Lean2 changes from 1→0, the rich correction value update direction flag (f_F_Hos_RL) is set to 0, and the rich correction is performed.

As described above, A1 and A2 are set to, for example, 0.9 [V]. In addition, B1 and B2 are set to, for example, 0.2 [V].

ΔTa and ΔTb have sensitivity to the OSC performance (=maximum oxygen storageable amount) and the intake air amount as well as the actual air-fuel ratio (rich level), and hence the table (Tbl_T2) and the table (Tbl_T3) are used for correction thereof. There are a large number of known technologies concerning a method of obtaining the maximum oxygen storage amount (Max_OSC), and hence the details thereof are not described herein.

Third Embodiment

In the second embodiment described above, the required times ΔTa and ΔTb are used, and the air-fuel ratio at the next and subsequent restarts is corrected so that ΔTa is equal to or larger than the predetermined value T2 and ΔTb is equal to or smaller than the predetermined value T3. In a third embodiment, the air-fuel ratio at the next and subsequent restarts is corrected so that a ratio R_ΔT of ΔTa and ΔTb is equal to or larger than a predetermined value R1.

In the third embodiment, the basic fuel injection amount calculation means 120 (FIG. 23), the starting fuel injection amount correction value calculation means 130 (FIG. 24), the rich control permission flag calculation means 131 (FIG. 25), and the normal-time air-fuel ratio feedback control means 140 (FIG. 28), which are described in the above, are basically the same as those of the first and second embodiments, and thus will not be described in detail again.

Hereinafter, rich correction value calculation means 332 and rich correction value update direction flag calculation means 335, which are different from those of the first and second embodiments, are described.

<Rich Correction Value Calculation Means 332 (FIG. 30)>

Figure 30:
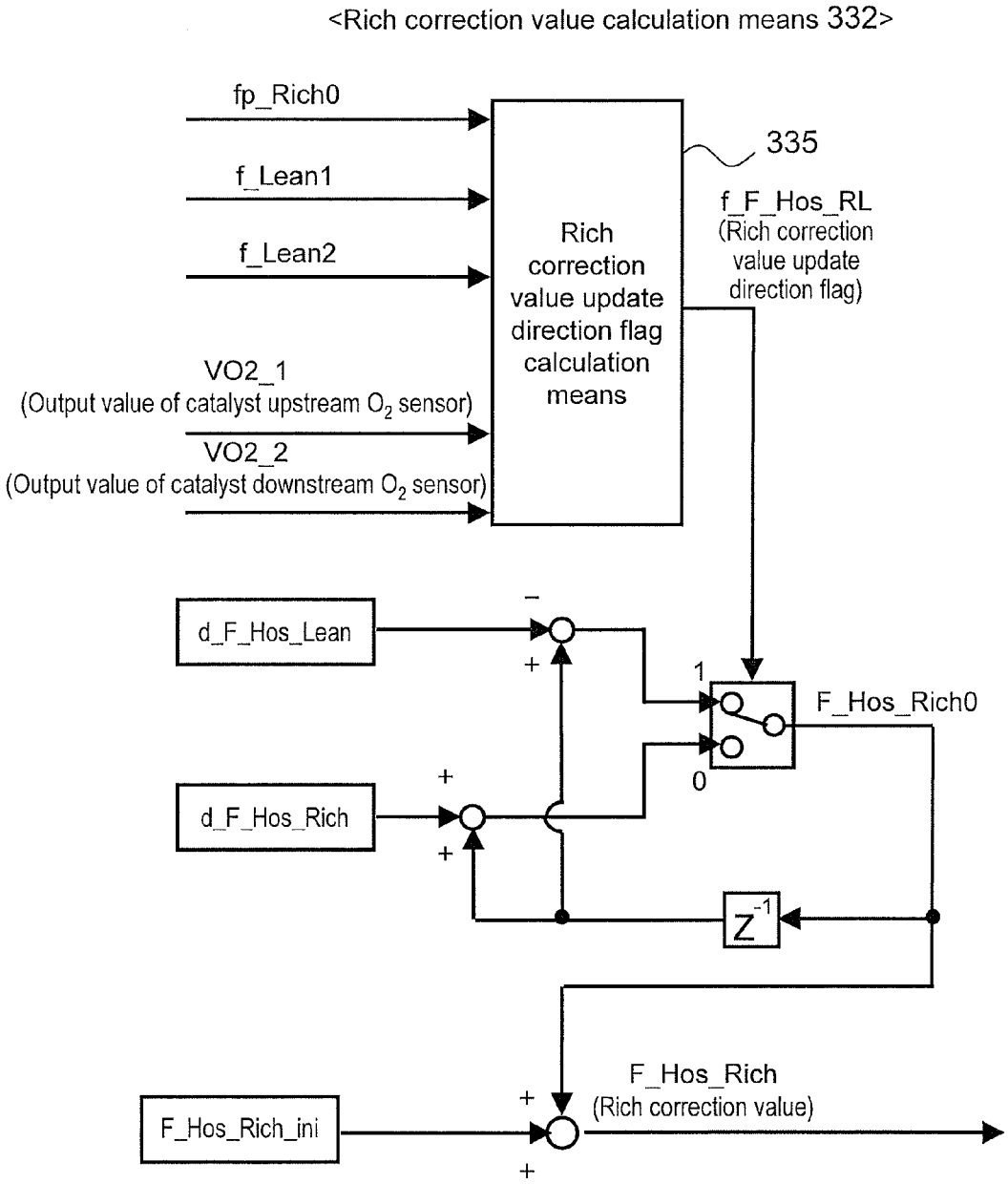
FIG. 30 is a diagram which is used for describing rich correction value calculation means according to the third embodiment.

This calculation means 332 calculates the rich correction value (F_Hos_Rich). When the starting rich control permission flag (fp_Rich) changes from 1→0, as illustrated in FIG. 30, this calculation means 332 is implemented, whereby the rich correction value (F_Hos_Rich) is updated. In other cases, the previous value is kept as the rich correction value (F_Hos_Rich). This calculation means 332 is different from the rich correction value calculation means 132 (FIG. 26) of the first embodiment only in that the air amount (Qa) is not inputted to rich correction value update direction flag calculation means 335 (to be described later), and the other feature is the same. Accordingly, the detailed description thereof is omitted.

Figure 31:
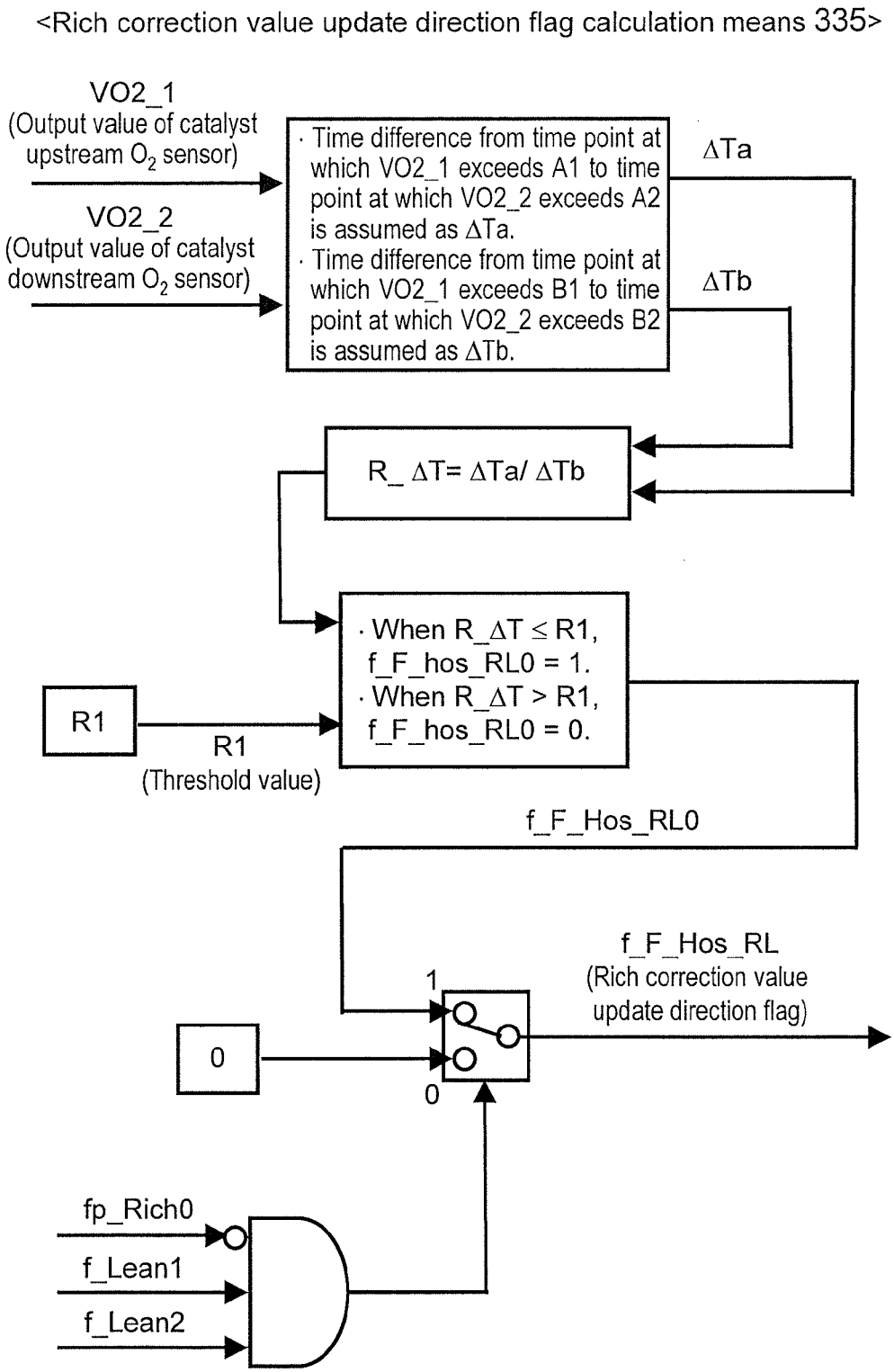
FIG. 31 is a diagram which is used for describing rich correction value update direction flag calculation means according to the third embodiment.

<Rich Correction Value Update Direction Flag Calculation Means 335 (FIG. 31)>

This calculation means 335 calculates the rich correction value update direction flag (f_F_Hos_RL). This is specifically illustrated in FIG. 31.

The required time from the time point at which the output value (VO_1) of the catalyst upstream O2 sensor exceeds A1 to the time point at which the output value (VO_2) of the catalyst downstream O2 sensor exceeds A2 is assumed as ΔTa.

The required time from the time point at which the output value (VO_1) of the catalyst upstream O2 sensor exceeds B1 to the time point at which the output value (VO_2) of the catalyst downstream O2 sensor exceeds B2 is assumed as ΔTb.

The ratio of ΔTa and ΔTb is assumed as R_ΔT.

When R_ΔT R1, f_F_hos_RL0 is set to 1. In other cases, f_F_hos_RL0 is set to 0.

The threshold R1 is set to a fixed value (does not have sensitivity to the air amount and the maximum oxygen storage amount).

When f_Lean1=1 and f_Lean2=1 and when fp_Rich0 changes from 1→0, a value of f_F_hod_RL0 is used as the rich correction value update direction flag (f_F_Hos_RL). In other cases, the rich correction value update direction flag (f_F_Hos_RL) is set to 0.

As described above, when the starting rich control permission flag (fp_Rich) changes from 1→0, the rich correction value calculation means 332 (FIG. 30) implements this calculation means 335, whereby the rich correction value (F_Hos_Rich) is updated. In other cases, the previous value is kept as the rich correction value (F_Hos_Rich).

The starting rich control permission flag (fp_Rich) is calculated by the "rich control permission flag calculation means (FIG. 25)", and in any one of the case where fp_Rich0 changes from 1→0, the case where f_Lean1 changes from 1→0, and the case where f_Lean2 changes from 1→0, the starting rich control permission flag (fp_Rich) changes from 1→0. When fp_Rich0 changes from 1→0, a value of f_F_hod_RL0 is used as the rich correction value update direction flag (f_F_Hos_RL) (whether to perform the rich correction or the lean correction is decided on the basis of a value of ΔTa). When f_Lean1 changes from 1→0 or when f_Lean2 changes from 1→0, the rich correction value update direction flag (f_F_Hos_RL) is set to 0, and the rich correction is performed.

As described above, A1 and A2 are set to, for example, 0.9 [V]. In addition, B1 and B2 are set to, for example, 0.2 [V].

Fourth Embodiment

In the first embodiment described above, the air-fuel ratio at the next and subsequent restarts is corrected on the basis of the required time ΔTa from the time point at which the output value of the catalyst upstream O2 sensor 12 exceeds the predetermined value A1 to the time point at which the output value of the catalyst downstream O2 sensor exceeds the predetermined value A2. In the fourth embodiment, the air-fuel ratio at the next and subsequent restarts is corrected so that the output value of the catalyst downstream O2 sensor 20 falls within a predetermined range.

In the fourth embodiment, the basic fuel injection amount calculation means 120 (FIG. 23), the rich control permission flag calculation means 131 (FIG. 25), and the normal-time air-fuel ratio feedback control means 140 (FIG. 28), which are described in the above, are basically the same as those of the first to third embodiments, and thus will not be described in detail again.

Hereinafter, starting fuel injection amount correction value calculation means 430, rich correction value calculation means 432, and rich correction value update direction flag calculation means 435, which are different from those of the first to third embodiments, are described.

Figure 32:
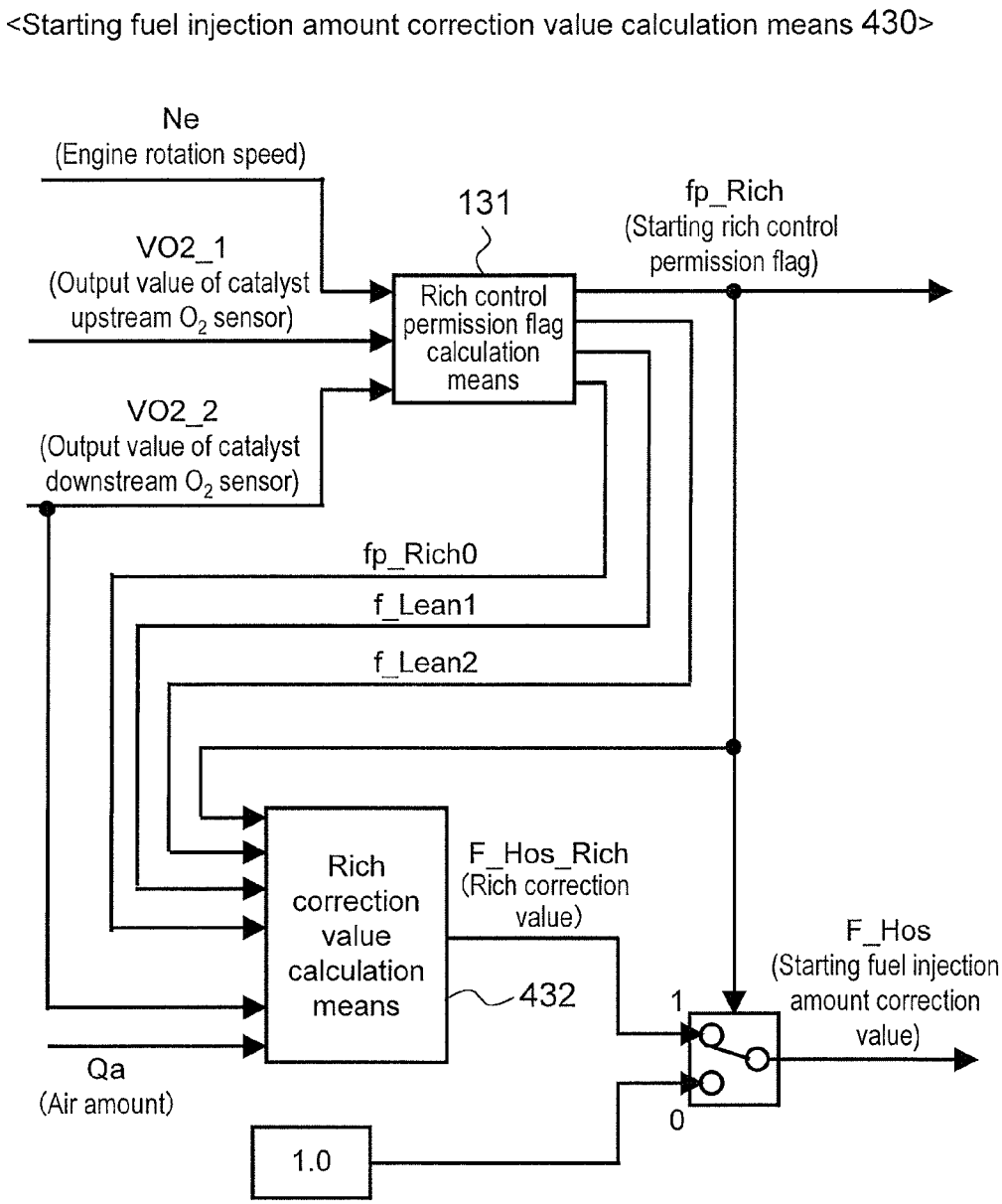
FIG. 32 is a diagram which is used for describing starting fuel injection amount correction value calculation means according to the fourth embodiment.

<Starting Fuel Injection Amount Correction Value Calculation Means 430 (FIG. 32)>

This calculation means 430 calculates the starting fuel injection amount correction value (F_Hos). This is specifically illustrated in FIG. 32. This calculation means 430 is different from the starting fuel injection amount correction value calculation means 130 (FIG. 24) of the first embodiment only in that the output value (VO_1) of the catalyst upstream O2 sensor is not inputted to the rich correction value calculation means, and the other feature is the same. Accordingly, the detailed description thereof is omitted here.

<Rich Correction Value Calculation Means 432 (FIG. 33)>

Figure 33:
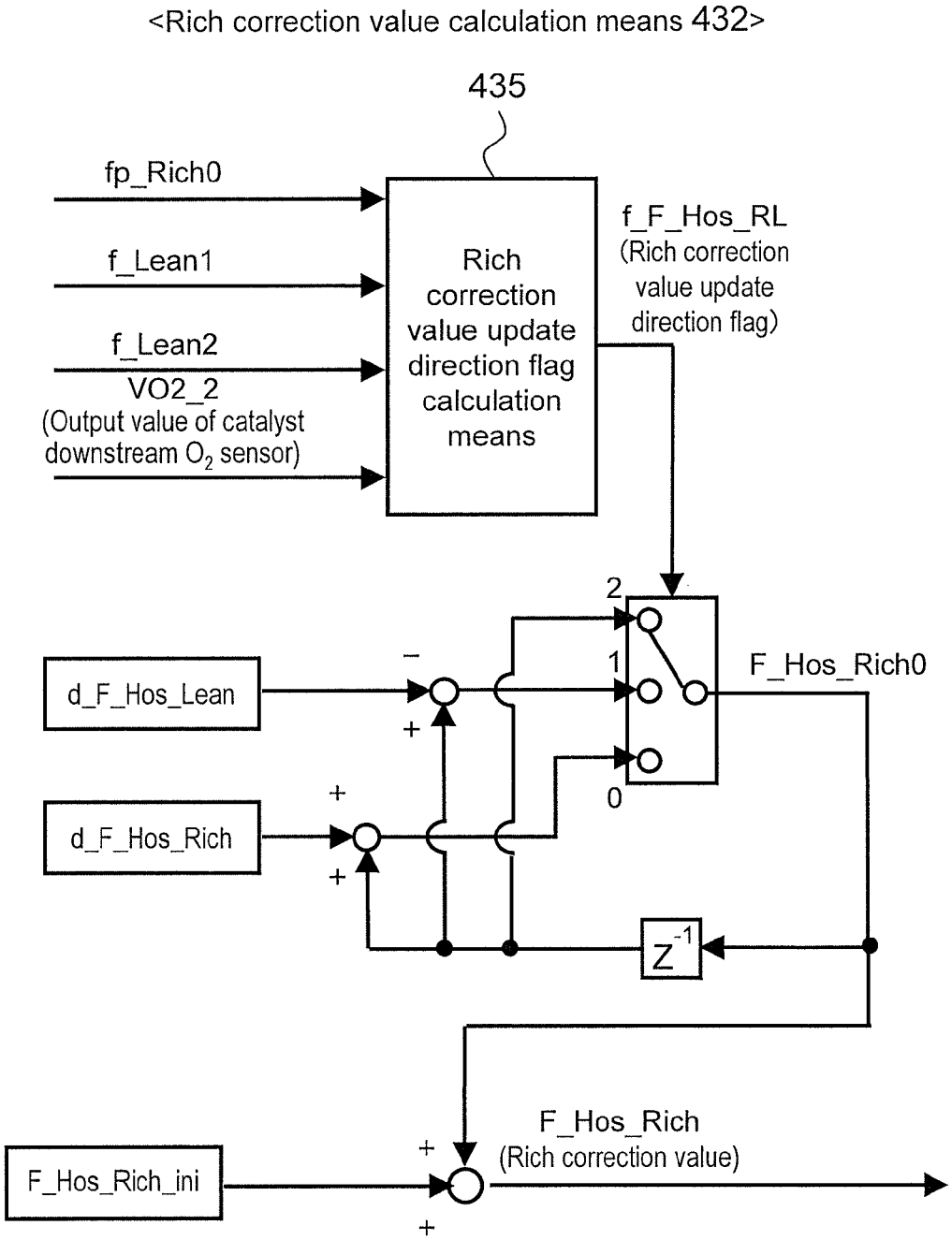
FIG. 33 is a diagram which is used for describing rich correction value calculation means according to the fourth embodiment.

This calculation means 432 calculates the rich correction value (F_Hos_Rich). When the starting rich control permission flag (fp_Rich) changes from 1→0, as illustrated in FIG. 33, this calculation means 432 is implemented, whereby the rich correction value (F_Hos_Rich) is updated. In other cases, the previous value is kept as the rich correction value (F_Hos_Rich).

The rich correction value update direction flag calculation means 435 (to be described later) calculates the rich correction value update direction flag (f_F_Hos_RL) on the basis of the output value (VO_2) of the catalyst downstream O2 sensor and the respective flags of fp_Rich0, f_Lean1, and f_Lean2.

When the rich correction value update direction flag (f_F_Hos_RL) is 2, the previous value of F_Hos_Rich0 is kept. When the rich correction value update direction flag (f_F_Hos_RL) is 1, a value obtained by subtracting d_F_Hos_Lean from the previous value of F_Hos_Rich0 is set as the latest F_Hos_Rich0. When the rich correction value update direction flag (f_F_Hos_RL) is 0, a value obtained by adding d_F_Hos_Rich to the previous value of F_Hos_Rich0 is set as the latest F_Hos_Rich0.

The rich correction value (F_Hos_Rich) is set to a value obtained by adding F_Hos_Rich0 to F_Hos_Rich_ini. F_Hos_Rich_ini is an initial value of the rich correction value (F_Hos_Rich). F_Hos_Rich_ini is set to such a value that can realize a proper rich level in accordance with the characteristics of a target engine by considering a control error of the air-fuel ratio control system at the start and the like. The rich correction values (d_F_Hos_Lean and d_F_Hos_Rich) which are updated for each restart are set in accordance with the characteristics of the target engine and a target catalyst by considering a correction speed and stability (oscillation properties).

Figure 34:
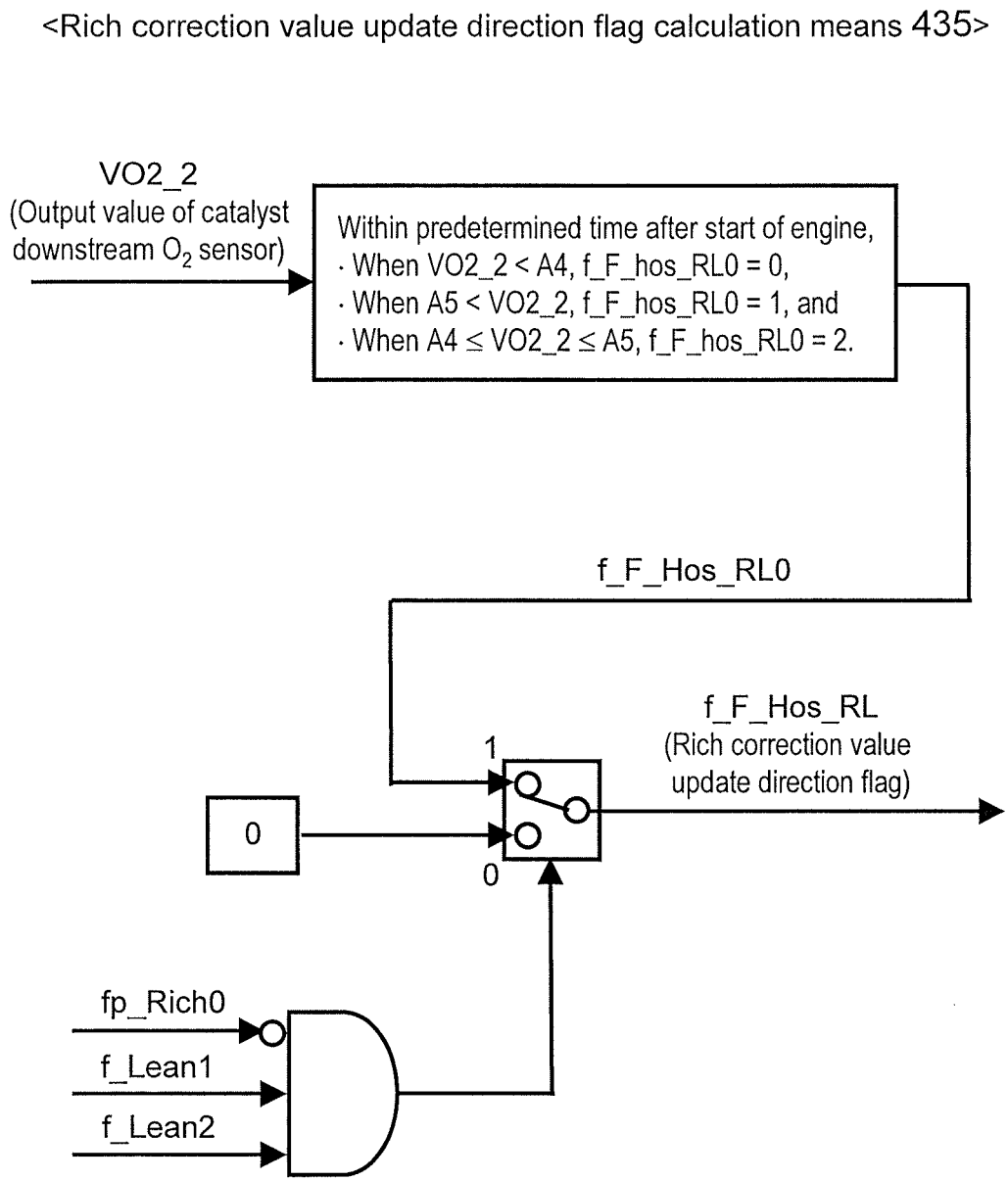
FIG. 34 is a diagram which is used for describing rich correction value update direction flag calculation means according to the fourth embodiment.

<Rich Correction Value Update Direction Flag Calculation Means 435 (FIG. 34)>

This calculation means 435 calculates the rich correction value update direction flag (f_F_Hos_RL). This is specifically illustrated in FIG. 34.

Within a predetermined time after the start of the engine, when the output value (VO_2) of the catalyst upstream O2 sensor is smaller than A4, f_F_hos_RL0 is set to 0. When the output value (VO_2) of the catalyst upstream O2 sensor is larger than A5, f_F_hos_RL0 is set to 1. When the output value (VO_2) of the catalyst upstream O2 sensor is equal to or larger than A4 and is equal to or smaller than A5, f_F_hos_RL0 is set to 2.

When f_Lean1=1 and f_Lean2=1 and when fp_Rich0 changes from 1→0, a value of f_F_hod_RL0 is used as the rich correction value update direction flag (f_F_Hos_RL). In other cases, the rich correction value update direction flag (f_F_Hos_RL) is set to 0.

As described above, when the starting rich control permission flag (fp_Rich) changes from 1→0, the rich correction value calculation means 432 (FIG. 33) implements this calculation means 435, whereby the rich correction value (F_Hos_Rich) is updated. In other cases, the previous value is kept as the rich correction value (F_Hos_Rich). The starting rich control permission flag (fp_Rich) is calculated by the rich control permission flag calculation means (FIG. 25), and in any one of the case where fp_Rich0 changes from 1→0, the case where f_Lean1 changes from 1→0, and the case where f_Lean2 changes from 1→0, the starting rich control permission flag (fp_Rich) changes from 1→0.

When fp_Rich0 changes from 1→0, a value of f_F_hod_RL0 is used as the rich correction value update direction flag (f_F_Hos_RL) (whether to perform the rich correction or the lean correction is decided on the basis of a value of ΔTa).

When f_Lean1 changes from 1→0 or when f_Lean2 changes from 1→0, the rich correction value update direction flag (f_F_Hos_RL) is set to 0, and the rich correction is performed.

A4 is set to, for example, 0.5 [V]. In addition, A5 is set to, for example, 0.9 [V]. In accordance with this, A3 in the rich control permission flag calculation means 131 (FIG. 25) is set to, for example, 0.5 [V].

[Operations and Effects of Embodiments]

As is understood from the descriptions given hereinabove, in the control device according to the embodiments of the present invention, at the restart after the idle stop, the air-fuel ratio is controlled to be rich, and further, the atmosphere inside of the catalyst is estimated on the basis of the output values at this time of the catalyst upstream and downstream O2 sensors 12 and 20. Then, on the basis of the result of the estimation, the air-fuel ratio (the fuel amount and the air amount) at the next and subsequent restarts is corrected so that the atmosphere inside of the catalyst is optimized at the next and subsequent restarts. Therefore, the atmosphere inside of the catalyst at the restart is optimized each time the restart after the idle stop is repeated. As a result, it becomes possible to purify NOx with high efficiency at the restart without deteriorating the purification efficiency of HC and CO, to thereby efficiently suppress the exhaust deterioration at the restart.

The control device for the engine according to the present invention, which mainly performs control at a restart after an idle stop, includes: first oxygen concentration detection means which is provided upstream of a catalyst; second oxygen concentration detection means which is provided downstream of the catalyst; means which controls an air-fuel ratio at the restart to be rich; means which detects, at the restart, a required time ΔT from a time point at which an output value of the first oxygen concentration detection means falls below a predetermined value A1 af to a time point at which an output value of the second oxygen concentration detection means exceeds a predetermined value A2; and means which corrects an air-fuel ratio at next and subsequent restarts on the basis of the required time ΔT.

The control device for the engine according to the present invention, which mainly performs control at a restart after an idle stop, includes: second oxygen concentration detection means which is provided downstream of a catalyst; rich control means which controls an air-fuel ratio at the restart to be rich; and air-fuel ratio correction means which corrects, within a predetermined time from the restart, an air-fuel ratio at next and subsequent restarts so that an output value of the second oxygen concentration detection means is equal to or larger than a predetermined value A4 and is equal to or smaller than a predetermined value A5.

In the control device for the engine according to the present invention, the predetermined value A4 is set to a value equal to or larger than 0.5 V, and the predetermined value A5 is set to a value equal to or smaller than 0.9 V.

In the control device for the engine according to the present invention, at the restart after the idle stop, an air-fuel ratio profile or a minimum value of the air-fuel ratio during the rich control is changed for each restart.

The control device for the engine according to the present invention further includes means which permits feedback control for correcting a fuel injection amount based on the output value of the first oxygen concentration detection means or the output value of the second oxygen concentration detection means, if the value of the second oxygen concentration detection means does not exceed the predetermined value A2 even after a lapse of a predetermined time TLa2 from a start of the engine or a first fuel injection.

The invention claimed is:

1. A control device for an engine, which mainly performs control at a restart after an idle stop, comprising:

first oxygen concentration detection means which is provided upstream of a catalyst;

second oxygen concentration detection means which is provided downstream of the catalyst;

rich control means which controls an air-fuel ratio at the restart to be rich;

required time detection means which detects, at the restart, a required time ΔT from a time point at which an output value of the first oxygen concentration detection means exceeds a predetermined value A1 to a time point at which an output value of the second oxygen concentration detection means exceeds a predetermined value A2; and air-fuel ratio correction means which corrects an air-fuel ratio at next and subsequent restarts on the basis of the required time ΔT.

2. The control device for the engine according to claim 1, wherein the predetermined value A1 and the predetermined value A2 are each set to a value equal to or larger than 0.5 V.

3. The control device for the engine according to claim 1, wherein the air-fuel ratio correction means corrects the air-fuel ratio at the next and subsequent restarts so that the required time ΔT is equal to or larger than a predetermined time T1.

4. The control device for the engine according to claim 3, further comprising means which changes the predetermined time T1 in accordance with at least one of a maximum oxygen storageable amount and an intake air amount of the catalyst.

5. The control device for the engine according to claim 1, further comprising means which detects a difference between an actual air-fuel ratio at the restart and a target air-fuel ratio on the basis of the required time ΔT, wherein the air-fuel ratio correction means corrects the air-fuel ratio at the next and subsequent restarts on the basis of the difference.

6. The control device for the engine according to claim 1, comprising, as the required time detection means:

means which detects a required time ΔTa from the time point at which the output value of the first oxygen concentration detection means exceeds the predetermined value A1 to the time point at which the output value of the second oxygen concentration detection means exceeds the predetermined value A2; and means which detects a required time ΔTb from a time point at which the output value of the first oxygen concentration detection means exceeds a predetermined value B1 to a time point at which the output value of the second oxygen concentration detection means exceeds a predetermined value B2, wherein the air-fuel ratio correction means corrects the air-fuel ratio at the next and subsequent restarts on the basis of at least one of the required time ΔTa and the required time ΔTb.

7. The control device for the engine according to claim 6, wherein:

the predetermined value A1 is set to a value equal to or larger than the predetermined value B1, and the predetermined value A2 is set to a value equal to or larger than the predetermined value B2; and the air-fuel ratio correction means corrects the air-fuel ratio at the next and subsequent restarts so that the required time ΔTa is equal to or larger than a predetermined value T2 and the required time ΔTb is equal to or smaller than a predetermined value T3.

8. The control device for the engine according to claim 6, further comprising ratio calculation means which calculates a ratio R_ΔT of the required time ΔTa and the required time ΔTb, wherein the air-fuel ratio correction means corrects the air-fuel ratio at the next and subsequent restarts on the basis of the ratio R_ΔT.

9. The control device for the engine according to claim 8, wherein the air-fuel ratio correction means corrects the air-fuel ratio at the next and subsequent restarts on the basis of a difference between the ratio R_ΔT calculated by the ratio calculation means and a predetermined value R1.

10. The control device for the engine according to claim 6, wherein the predetermined value A1 and the predetermined value A2 are each set to a value equal to or larger than 0.5 V, and the predetermined value B1 and the predetermined value B2 are each set to a value equal to or smaller than 0.5 V.

11. The control device for the engine according to claim 1, further comprising means which ends rich control at the restart performed by the rich control means, when the output value of the second oxygen concentration detection means exceeds a predetermined value A3.

12. The control device for the engine according to claim 1, further comprising means which permits feedback control for correcting a fuel injection amount based on the output value of the first oxygen concentration detection means and/or the output value of the second oxygen concentration detection means, after the output value of the second oxygen concentration detection means has exceeded the predetermined value A2.

13. The control device for the engine according to claim 1, further comprising means which controls the air-fuel ratio to be richer, if the output value of the first oxygen concentration detection means does not exceed the predetermined value A1 even after a lapse of a predetermined time TLa1 from a start of the engine or a first fuel injection.

14. The control device for the engine according to claim 1, further comprising means which permits feedback control for correcting a fuel injection amount based on the output value of the first oxygen concentration detection means or the output value of the second oxygen concentration detection means, if the output value of the first oxygen concentration detection means does not exceed the predetermined value A1 even after a lapse of a predetermined time TLa1 from a start of the engine or a first fuel injection.

15. The control device for the engine according to claim 1, further comprising means which controls the air-fuel ratio to be richer, if the output value of the second oxygen concentration detection means does not exceed the predetermined value A2 even after a lapse of a predetermined time TLa2 from a start of the engine or a first fuel injection.

* * * * *